United States Patent [19]

McTamaney et al.

[11] Patent Number: 4,487,061

[45] Date of Patent: Dec. 11, 1984

[54] METHOD AND APPARATUS FOR DETECTING WELL PUMP-OFF

[75] Inventors: Louis S. McTamaney, Cupertino; Allan B. Delfino, Sunnyvale; Delbert F. Waltrip; Thomas I. Kirkpatrick, both of San Jose, all of Calif.

[73] Assignee: FMC Corporation, Chicago, Ill.

[21] Appl. No.: 450,597

[22] Filed: Dec. 17, 1982

[51] Int. Cl.[3] ..... F04B 49/00; E21B 44/00

[52] U.S. Cl. ..... 73/151; 74/41; 166/53; 417/12

[58] Field of Search ..... 166/53; 74/41; 73/151; 417/12, 44

[56] References Cited

U.S. PATENT DOCUMENTS

| | | | |
|---|---|---|---|
| 2,577,479 | 12/1951 | Owen et al. | 192/116.5 |
| 3,306,210 | 2/1967 | Boyd et al. | 103/25 |
| 3,817,094 | 6/1974 | Montgomery et al. | 73/151 |
| 3,824,851 | 7/1974 | Hagar et al. | 73/151 |
| 3,838,597 | 10/1974 | Montgomery et al. | 73/151 |
| 3,851,995 | 12/1974 | Mills | 417/12 |
| 3,951,209 | 4/1976 | Gibbs | 166/250 |
| 4,015,469 | 4/1977 | Womack et al. | 73/151 |
| 4,034,808 | 7/1977 | Patterson | 166/250 |
| 4,058,757 | 11/1977 | Welton et al. | 73/151 |
| 4,143,546 | 3/1979 | Wiener | 73/151 |
| 4,145,161 | 3/1979 | Skinner | 417/22 |
| 4,286,925 | 9/1981 | Standish | 417/12 |
| 4,307,395 | 12/1981 | Standish | 340/870.11 |
| 4,363,605 | 12/1982 | Mills | 417/44 |

*Primary Examiner*—Howard A. Birmiel

*Attorney, Agent, or Firm*—Lloyd B. Guernsey; Richard B. Megley

[57] ABSTRACT

Methods and apparatus for detecting fluid pound in a sucker-rod oil well, using maximum and minimum values of sucker-rod position and of sucker-rod load to calculate a reference position and a selected load value. The apparatus automatically calculates the reference position and the selected load value according to the characteristics of the well and of the well pumping equipment. When the sucker-rod moves downward to the reference position, the actual load value is checked against the selected value and in one embodiment of the invention a warning signal develops when the amount of the load exceeds the previously selected load quantity. In another embodiment a warning signal develops when the rate of change of the load is at a maximum below the reference position. In a third embodiment a warning signal develops when a minimum rate of change of the load occurs below the reference position.

31 Claims, 31 Drawing Figures

SET POINT FLUID POUND DETECTOR STATE DIAGRAM.

| | STATE 1 | STATE 2 | STATE 3 |
|---|---|---|---|
| MESSAGE 1 | PROCESS A | PROCESS D | PROCESS G |
| MESSAGE 2 | PROCESS B | PROCESS E | PROCESS H |
| MESSAGE 3 | PROCESS C | PROCESS F | PROCESS I |

DATA ACQUISITION

MATH PROCESSING

STROKE DISCRIMINATOR MESSAGE FLOW DIAGRAM

STROKE DISCRIMINATOR STATE DIAGRAM

STROKE DERIVATIVE DETECTOR STATE DIAGRAM

STROKE EXTREMES DETECTOR STATE DIAGRAM

STROKE AREA CALCULATOR STATE DIAGRAM

FLUID POUND DETECTOR

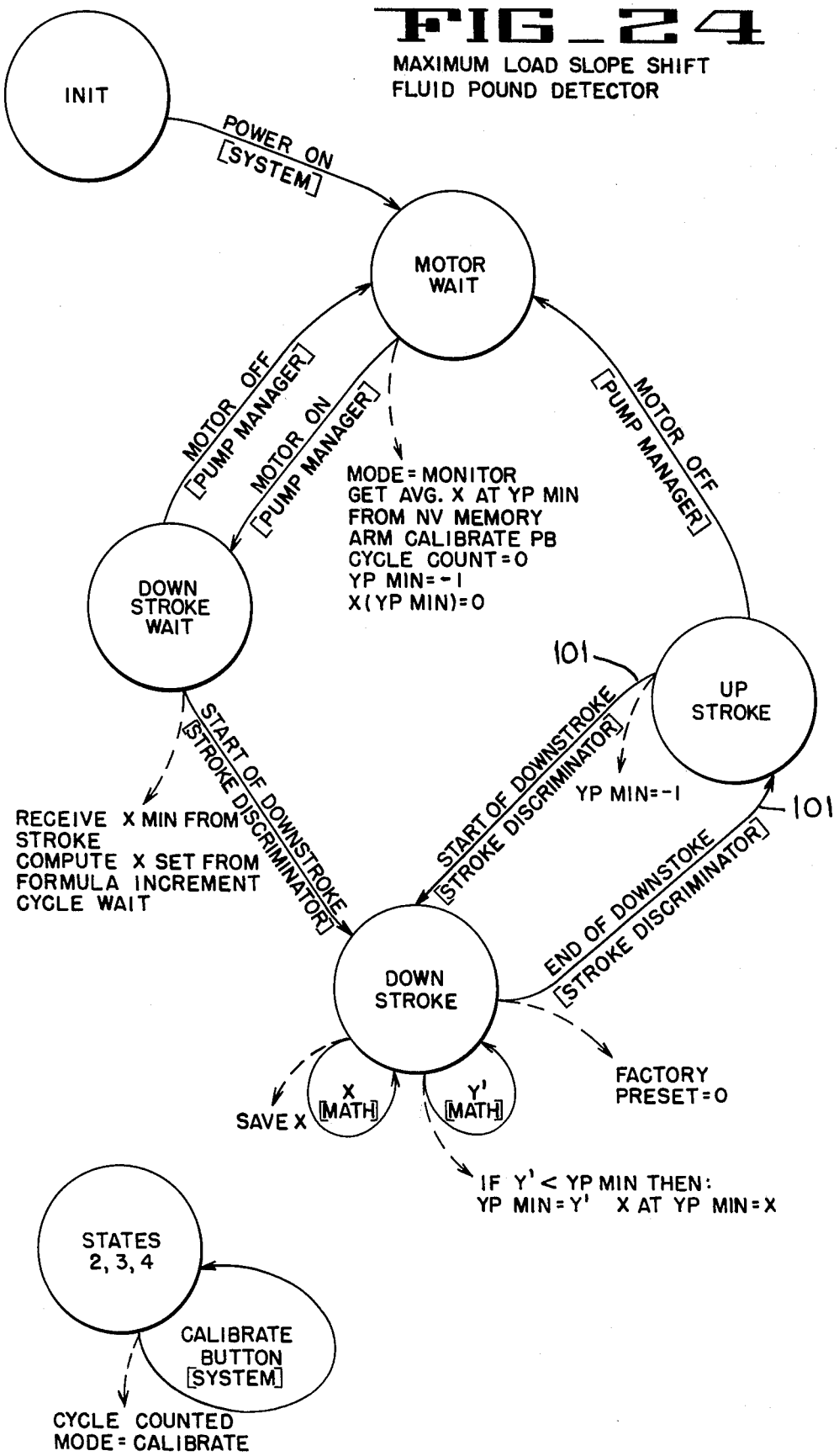
FIG_24
MAXIMUM LOAD SLOPE SHIFT
FLUID POUND DETECTOR
INIT
POWER ON
[SYSTEM]
MOTOR WAIT
MOTOR OFF
[PUMP MANAGER]
MOTOR ON
[PUMP MANAGER]
MOTOR OFF
[PUMP MANAGER]
MODE = MONITOR
GET AVG. X AT YP MIN
FROM NV MEMORY
ARM CALIBRATE PB
CYCLE COUNT = 0
YP MIN = -1
X(YP MIN) = 0
DOWN STROKE WAIT
UP STROKE
101
START OF DOWNSTROKE
[STROKE DISCRIMINATOR]
START OF DOWNSTROKE
[STROKE DISCRIMINATOR]
YP MIN = -1
101
END OF DOWNSTOKE
[STROKE DISCRIMINATOR]
RECEIVE X MIN FROM STROKE
COMPUTE X SET FROM FORMULA INCREMENT
CYCLE WAIT
DOWN STROKE
FACTORY PRESET = 0
SAVE X
X
[MATH]
Y'
[MATH]
IF Y' < YP MIN THEN:
YP MIN = Y' X AT YP MIN = X
STATES 2, 3, 4
CALIBRATE BUTTON
[SYSTEM]
CYCLE COUNTED
MODE = CALIBRATE FIG_25
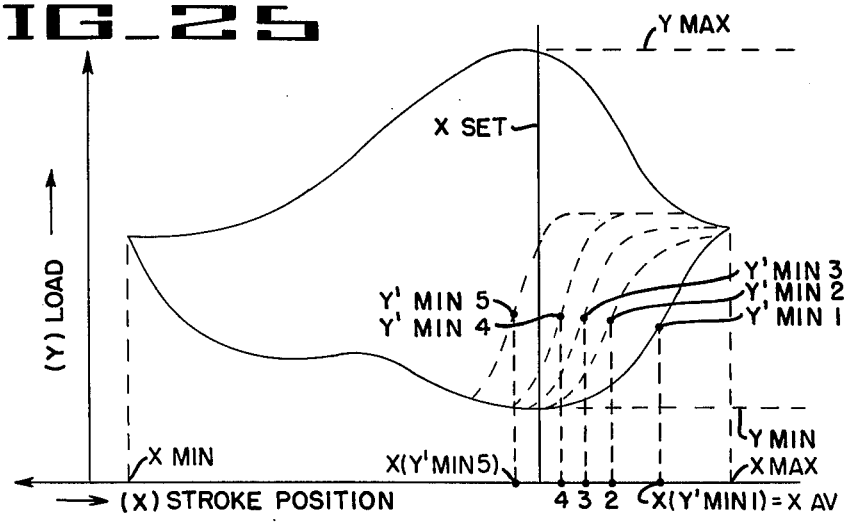
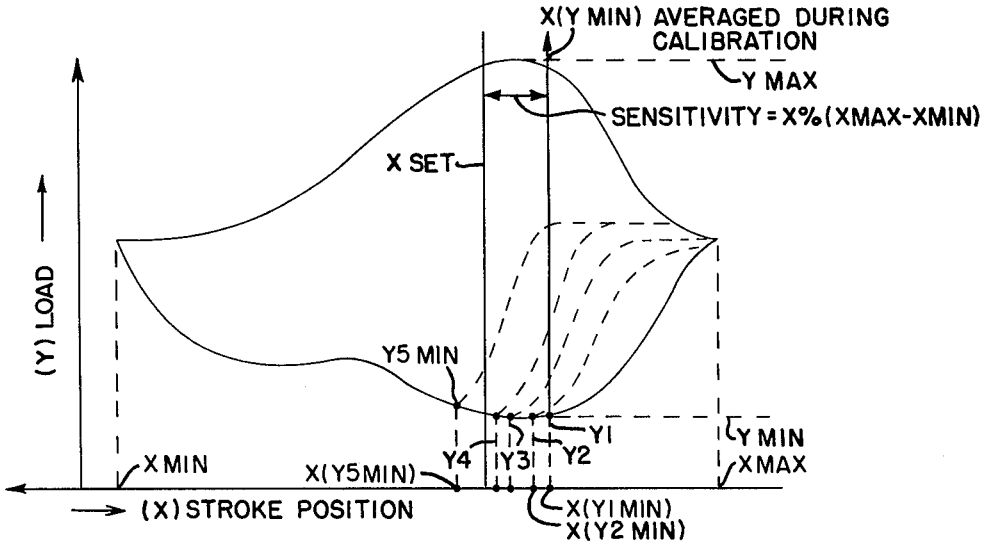
FIG_27
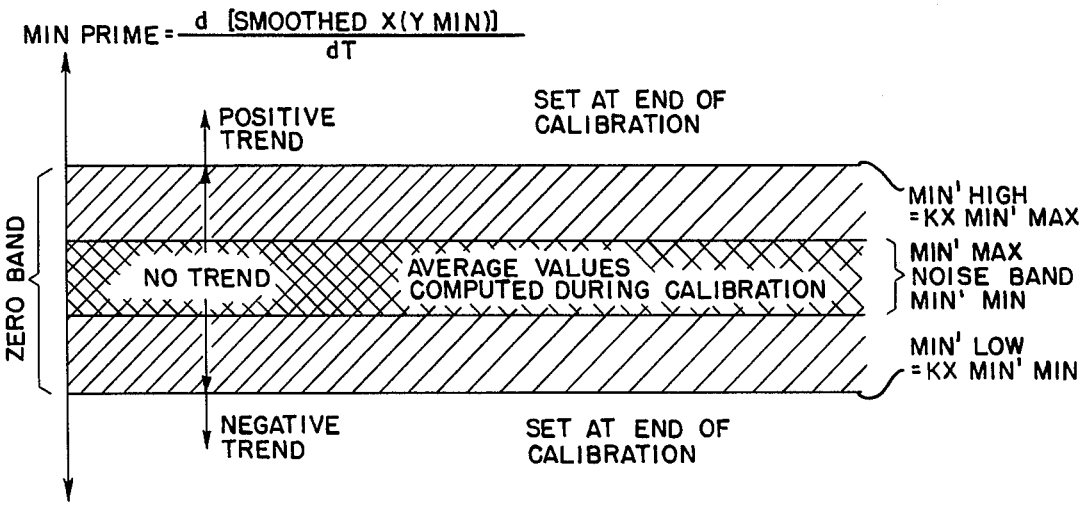
FIG_26

TREND DETECTOR MESSAGE FLOW

TREND DETECTOR SUPERVISOR

MIN POSITION MONITOR

METHOD AND APPARATUS FOR DETECTING WELL PUMP-OFF

BACKGROUND OF THE INVENTION

The present invention relates to methods and apparatus for monitoring the operation of sucker-rod well pumping units, and more particularly to methods and apparatus for detecting fluid pound in wells employing sucker-rod pumping units.

Sucker-rod type pumping units are widely used in the petroleum industry in order to recover fluid from wells extending into subterranean formations. Such units include a sucker-rod string which extends into the well and means at the surface for an up and down movement of the rod string in order to operate a downhole pump. Typical of such units are the so called "beam-type" pumping units having the sucker-rod string suspended at the surface of the well from a structure consisting of a Samson post and a walking beam pivotally mounted on the Samson post. The sucker-rod string normally is connected at one end of the walking beam and the other end of the walking beam is connected to a prime mover such as a motor through a suitable crank and pitman connection. In this arrangement the walking beam and the sucker-rod string are driven in a reciprocal mode by the prime mover.

A variety of malfunctions such as worn pumps, broken sucker-rods, split tubing, and stuck pump valves can interrupt the pumping of fluid from a well. Such malfunctions can be caused by normal wear and tear on the equipment, by the nature of the fluid being pumped or they could be caused by abnormal pumping conditions.

One abnormal pumping condition which is fairly common is known as "fluid pound". Fluid pound occurs when the well is pumped-off, i.e., when fluid is withdrawn from the well at a rate greater than the rate at which fluid enters the well from the formation. When this occurs, the working well of the downhole pump is only partially filled during an upstroke of the plunger and on the down stroke the plunger strikes or "pounds" the fluid in the working barrel causing severe jarring of the entire pumping unit. This causes damage to the rod string and to the surface equipment and may lead to failure of the pumping unit.

SUMMARY OF THE INVENTION

The present invention provides new and improved methods and apparatus for detecting fluid pound in a well pumping unit having a sucker-rod string and a power unit to reciprocate the rod string to produce fluid from a well. A load cell is connected between the sucker-rod string and the power unit to develop a signal representative of the load on the rod string, and a transducer is connected to generate a signal representative of the position of the rod string. In a first mode of operation of the present invention an updating means uses the load signal to establish a selected value of this load signal and uses the rod string position to establish a reference position of the rod string. Means are provided for monitoring the load signal when the rod string reaches the reference position and means are provided for disabling the power unit when an absence of fluid below the pump plunger causes the load signal to exceed the selected value with the rod string at the reference position.

In a second mode of operation of the present invention the updating means uses the rod string position to establish a reference position of the rod string and uses the load signal to establish the rate of change in the load on the rod string as the rod string moves in a downward direction. When the fluid level is below the pump plunger, the plunger moves downward at an accelerated rate of speed and the rod position at which the maximum rate of change occurs at a lower position in the downstroke as the fluid level moves downward. Means are provided for checking the rod position where the rate of change of rod load has a maximum value on the downstroke of the rod. Means are provided for disabling the power unit when the rod position at which the rod load rate of change has a maximum value is below the reference position.

In a third mode of operation of the present invention the updating means uses the shift of the position of the maximum value of the load signal to determine when the pump plunger is moving progressively lower before the plunger reaches the level of the fluid in the well. When this minimum load value is detected and the rod position is below the reference position the power unit is disabled.

The ability of the present invention to use rod string position signals in establishing a reference position for a particular well allows the apparatus to be used with a variety of wells and allows the well to be automatically recalibrated so the well equipment can be operated for extended periods of time without human intervention. The establishing means includes a microprocessor which stores programs and certain well parameters in nonvolatile memories so that a loss of power at the establishing means will not cause a loss of programs or well parameters, and so operation and control of the well will resume when power is restored.

The programs in the microprocessor can be selected so that any one or all of the three modes of operation of the present invention can be used with a well which is controlled by the well equipment. Wells differ in their individual characteristics and one of the modes may work best for a particular well. If desired, all of the modes of operation can be used with a given well and the microprocessor can be programmed to disable the power unit when any one or more of the modes determines that pump-off has occurred. The microprocessor can be also programmed to disable the power unit only when a majority of the modes of operation determine that pump-off has occurred. However, it has been found that a single mode of operation usually provides reliable detection of well pump-off.

BRIEF DESCRIPTION OF THE DRAWINGS

FIG. 24 is a message flow diagram for the fluid pound detector of FIG. 23.

FIG. 25 is a plot of position vs. load like FIG. 3, but illustrating a second mode of operation of the apparatus of FIG. 1.

FIG. 26 illustrates the calibration of the apparatus of FIG. 1 for use with the third mode of operation to reduce the effects of noise signals in the apparatus.

FIG. 27 is a plot of position vs. load like FIG. 3, but illustrating a third mode of operation of the apparatus of FIG. 1.

DESCRIPTION OF THE PREFERRED EMBODIMENT

Figure 1:
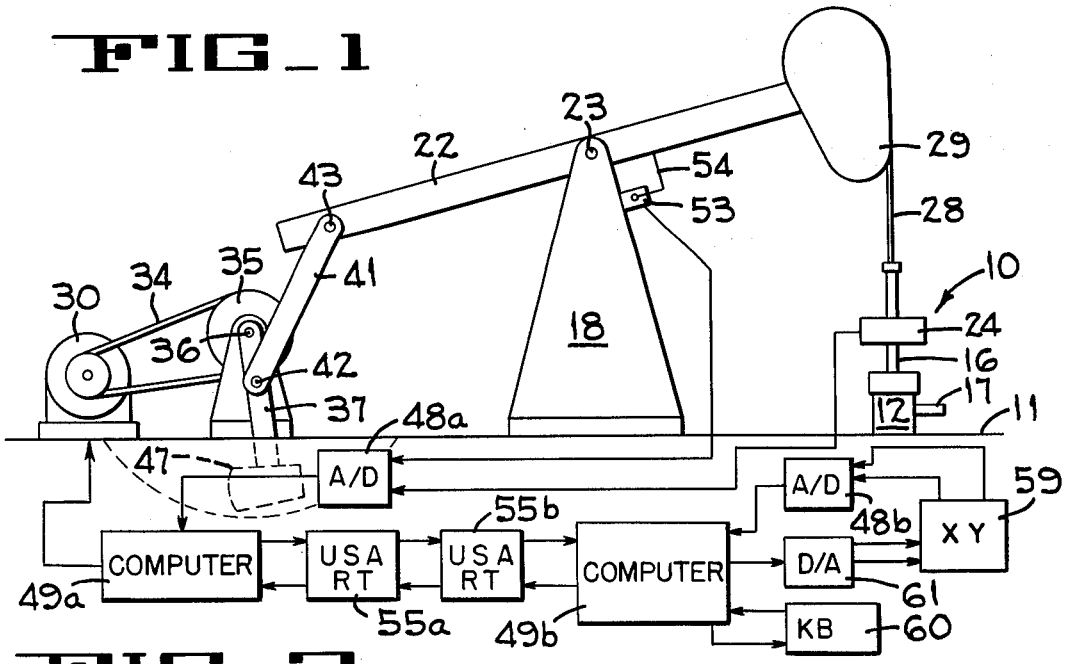
FIG. 1 is a diagrammatic illustration of a well equipped with a sucker-rod type pumping unit.

Referring to FIG. 1, there is illustrated a wellhead 10 of a well which extends from the earth's surface 11 into a subsurface well producing formation (not shown). The wellhead comprises the upper portions of a casing string 12 with a sucker-rod string 16 extending downward into a down hole pump (not shown) which moves liquid to the surface where it passes into a flow line 17. The sucker-rod string 16 is suspended in the well from a support unit consisting of a support post 18 and a walking beam 22 which is pivotally mounted on the support post by a pin connection 23. A load cell 24 is connected between the upper end of the sucker-rod string 16 and the lower end of a cable section 28. The cable section 28 is connected to the walking beam 22 by means of a horsehead 29.

The walking beam 22 is reciprocated by a prime mover such as an electric motor 30. The prime mover drives the walking beam through a drive system which includes a drive belt 34, crank 35, crank shaft 36, crank arm 37, and a pitman 41 which is pivotally connected between the crank arm and the walking beam by means of pin connections 42, 43. The outer end of the crank arm 37 is provided with a counterweight 47 which balances a portion of the load on the sucker-rod string in order to provide a more constant load on the prime mover.

The load cell 24 provides a DC output signal which is proportional to the load on the sucker-rod string 16, and an analog-to-digital converter 48*a* provides a corresponding digital signal to a computer 49*a*. A position measuring means or transducer 53 includes an actuating arm 54 for measuring the vertical position of the sucker-rod string 16 by providing a voltage which is proportional to the angle of the walking beam 22 and thus is proportional to the position of the rod string 16. The digital-to-analog converter 48*a* also converts the signal from the transducer 53 into a digital signal which is used by the computer 49*a*. Signals are transferred from the computer 49*a* to a computer 49*b* by a pair of universal synchronous asynchronous receiver transmitters (USARTs) 55*a*, 55*b* for controlling the operation of an XY plotter 59. Instructions from a keyboard and display unit 60 and output signals from the load cell 24 are used by the XY plotter to provide a visual plot of the characteristics of the particular well which the rod string operates. The plotter 59 can be used for observing operation of the well and for setting up the equipment to monitor the well. After setup is completed the plotter can be disconnected, or if desired the plotter can be eliminated altogether and other means for setting up the equipment can be used. Analog signals from the XY plotter 59 are converted into digital signals by an analog-to-digital converter 48*b* for use by the computer 49*b* and digital signals from the computer 49*b* are converted into analog signals by a digital-to-analog converter 61 for use by the plotter.

Figure 2:
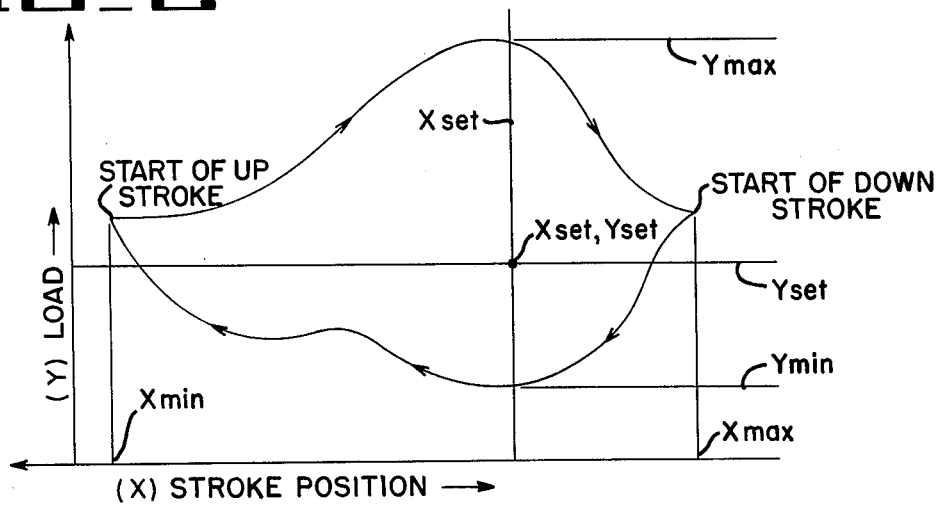
FIG. 2 is a plot of the position vs. load of the sucker-rod of the pump for one cycle of normal operation and showing a reference point in the plot.

A plot of the position versus load of the rod string 16 for a typical cycle of the rod string when the well is filled with fluid is disclosed in FIG. 2. It can be seen that as the rod string moves on the upstroke from the Xmin position to the Xmax position, the load on the string increases to a maximum value and then returns to approximately the initial value. Of more importance is the variation in the load as the rod string moves downward with the load decreasing to a minimum value at a fairly rapid rate and then moving upward to approximately the original value at the Xmin position.

As the well approaches pump-off (FIG. 3), the load on the rod string changes more rapidly as the rod string moves in a downward direction. When the fluid in the well drops, a pump plunger in the pump falls and strikes the surface of the fluid in the well producing a "fluid pound" which can damage the rod string and other parts of the pumping system. As the fluid level in the well decreases the pump plunger progressively moves a greater distance on the downstroke before contacting the surface of the fluid in the well causing the plotted load curve to progressively change from the full well curve 65 to the dotted curves 66–69 with the curve moving progressively toward the left as the fluid in the well drops lower. This moving trend can be observed and the pump shut down to prevent damage to the equipment.

The present invention provides a first method for detecting pump-off by using the apparatus of FIG. 1 to select a set point (Xset, Yset) (FIGS. 2, 3) having a value determined by the characteristics of each individual well and to change the set point when these characteristics change. The computer 49*a* (FIG. 1) compares the fluid pound curves 66–69 with the position of the set point and shuts down the motor 30 when the fluid pound curve moves to the left of the set point shown in FIG. 3.

A human operator uses the keyboard 60 or other input to the computer 49*b* (FIG. 1) to enter an X percentage value and a Y percentage value into the computer 49*b* which transfers these values to the computer 49*a* causing the computer 49*a* to calculate an Xset value the entered percent of the distance between Xmin and Xmax (FIG. 2), and to calculate a Yset value the entered percent of the distance between Ymin and Ymax thereby obtaining the position of the set point. The value of Xset and Yset can be computed using the following formulae:

$$Xset=(Xmax-X\ min)(X\ \%\div 100)+Xmin$$

$$Yset=(Ymax-Ymin)(Y\ \%\div 100)+Ymin$$

Figure 3:
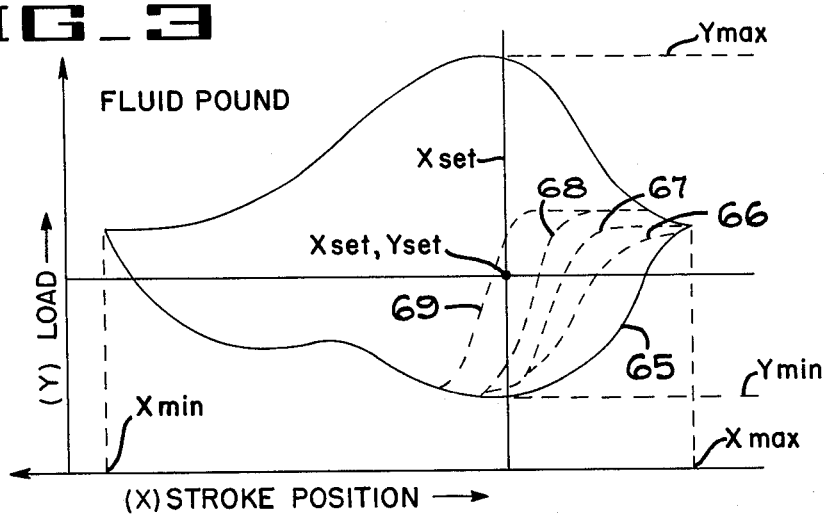
FIG. 3 is a plot of position vs. load of the sucker-rod as the well progresses into fluid pound.

The values of Xmax, Xmin, Ymax and Ymin which can be used are the maximum and minimum values of the curve of FIGS. 2 and 3. The X % and Y % are the percentage values selected by the human operator using knowledge of the well and of the pumping equipment in choosing these percentage values. Also any two nominal values of X and any two nominal values of Y can be selected instead of using the maximum and minimum values suggested. If the characteristics of the well or its pump, etc. should change so the curve of FIGS. 2 and 3 changes, the computer will recalculate the position of the set point.

When the set point (Xset, Yset) has been selected the computer continually monitors the X value of the curve (FIG. 3) during the downstroke of the plunger until the curve reaches the value of Xset as the curve moves from Xmax toward Xmin. With the curve at Xset point the computer checks the value of Y. If the value of Y is greater than the value of Yset the computer 49*a* (FIG. 1) provides a signal which causes the motor 30 to stop and the well is shut down. To insure that the well is really pumped-off at this time, it may be desirable to allow the pump to move through two or more cycles with the curve (FIG. 2) to the left of the set point each time, before the motor 30 is turned off. This prevents shut down of the well due to an erratic signal from the load cell 24 or from the transducer 53 or from other electronic equipment or from the behavior of the well itself.

It is also important to be able to distinguish the difference between fluid pound and "gas pound" in the well being monitored. Gas pound occurs when the well is filled with fluid but gas is present in the fluid being withdrawn from the well, and the gas delays the shift of the fluid load from a valve in the pump in the downstroke because the gas is compressible. However, the gas and fluid mixture offers more resistance to downward movement of the plunger than is offered in a pump-off condition so the plunger drops more slowly than in fluid pound. These differences can be seen by comparing the full well card of FIG. 2 with the fluid pound curve of FIG. 3 and with the gas pound curve of FIG. 4.

Figure 4:
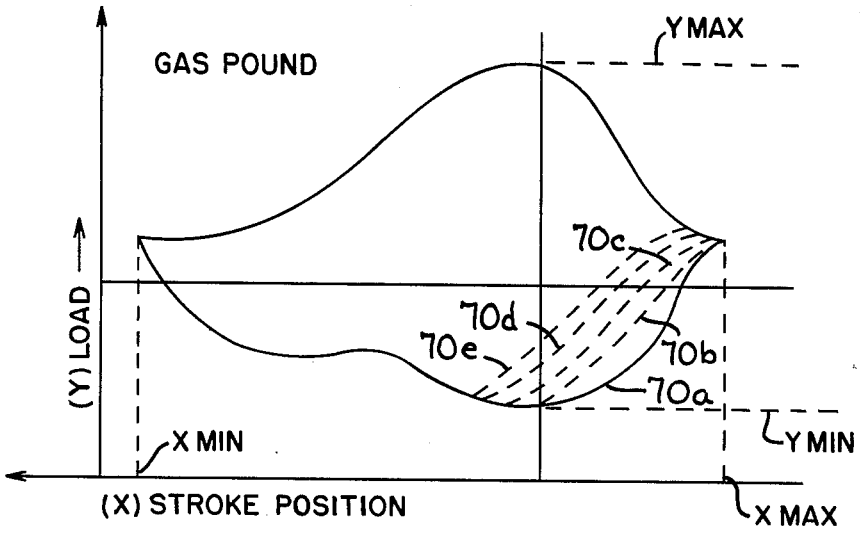
FIG. 4 is a plot of position vs. load of the sucker-rod as the well progresses into gas pound.
Figure 5:
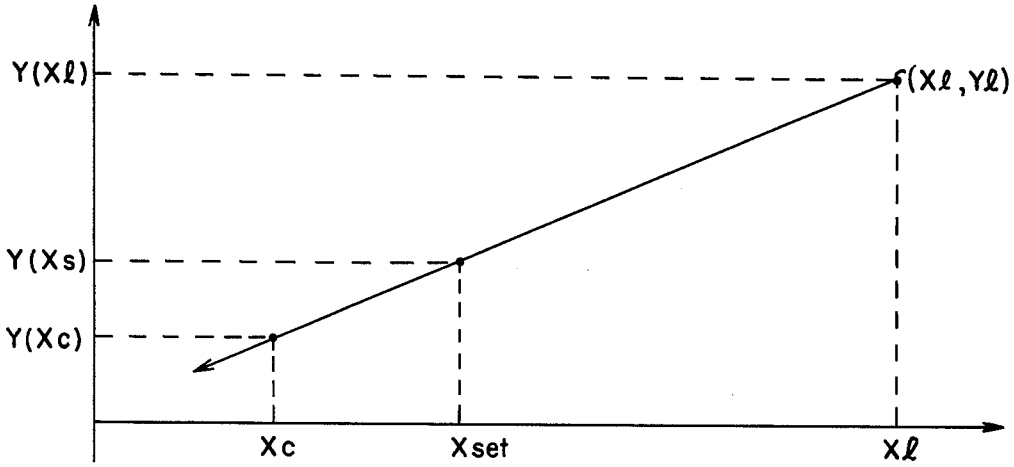
FIG. 5 is a graph illustrating the process of interpolation of values of sucker-rod position and load values to accurately determine the load value at a reference position.

The gas content of the fluid being pumped from a well may vary in an unpredictable manner so that the downward stroke of the pump plunger may jump back and forth in a random manner between the downstroke curves 70*a*–70*e* of FIG. 4. For example, on one downward stroke the load cell 24 and the stroke transducer 53 (FIG. 1) may provide the curve 70*b*, while the next downstroke develops the curve 70*e* and the next downstroke develops the curve 70*c*.

When a well is being pumped-off the fluid level gradually drops so the pump rod load follows curve 65 (FIG. 3) on one downstroke, then follows curve 66, then 67, etc. toward curve 69 with the output of the load cell 24 (FIG. 1) gradually moving toward the left on subsequent downstrokes, as seen in FIG. 3. This difference between a leftward trend in fluid pound and a random movement in gas pound can be used to aid in distinguishing between these two conditions.

Figure 6:
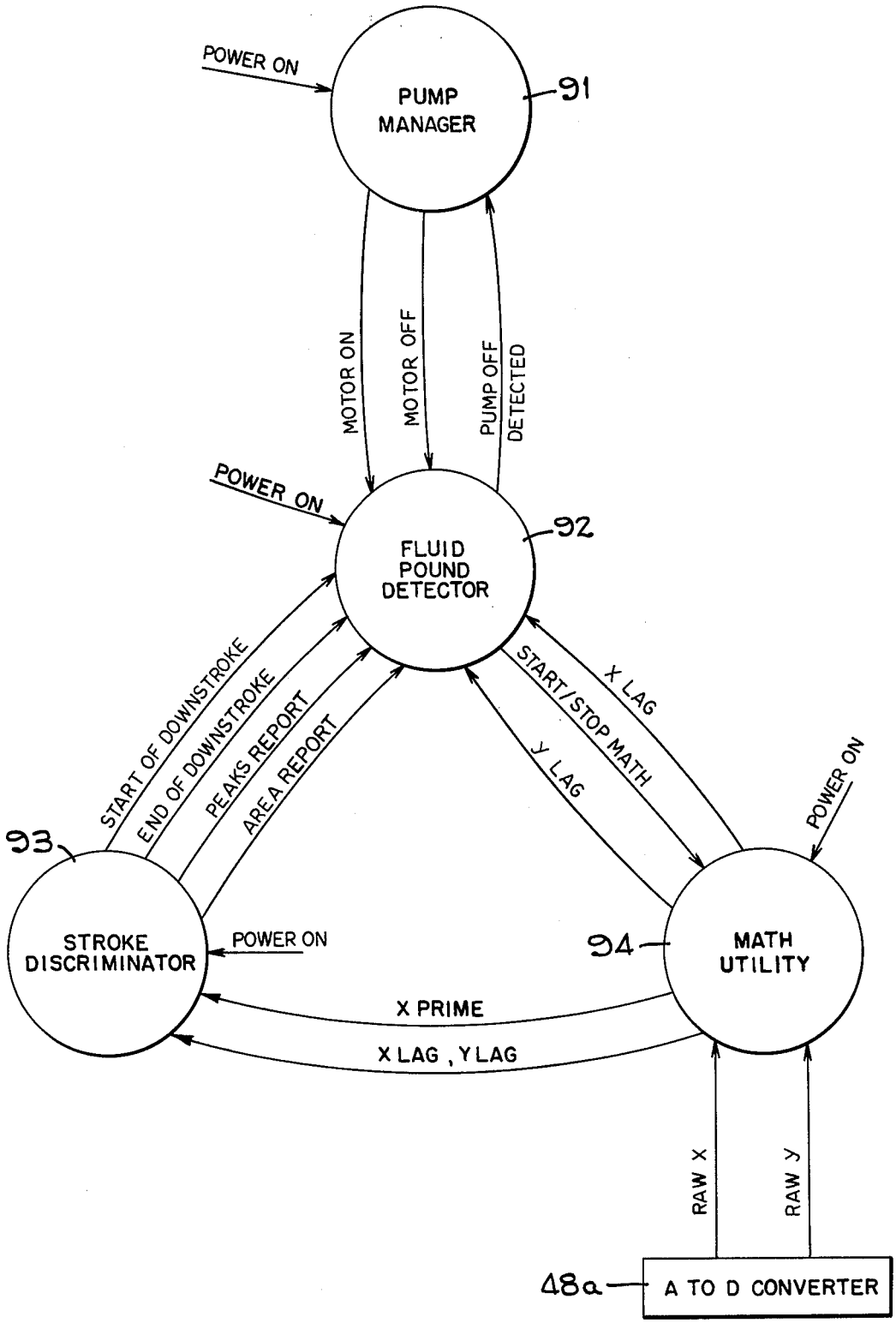
FIG. 6 is a message flow diagram showing a first mode of operation of the apparatus of FIG. 1.
Figure 7:
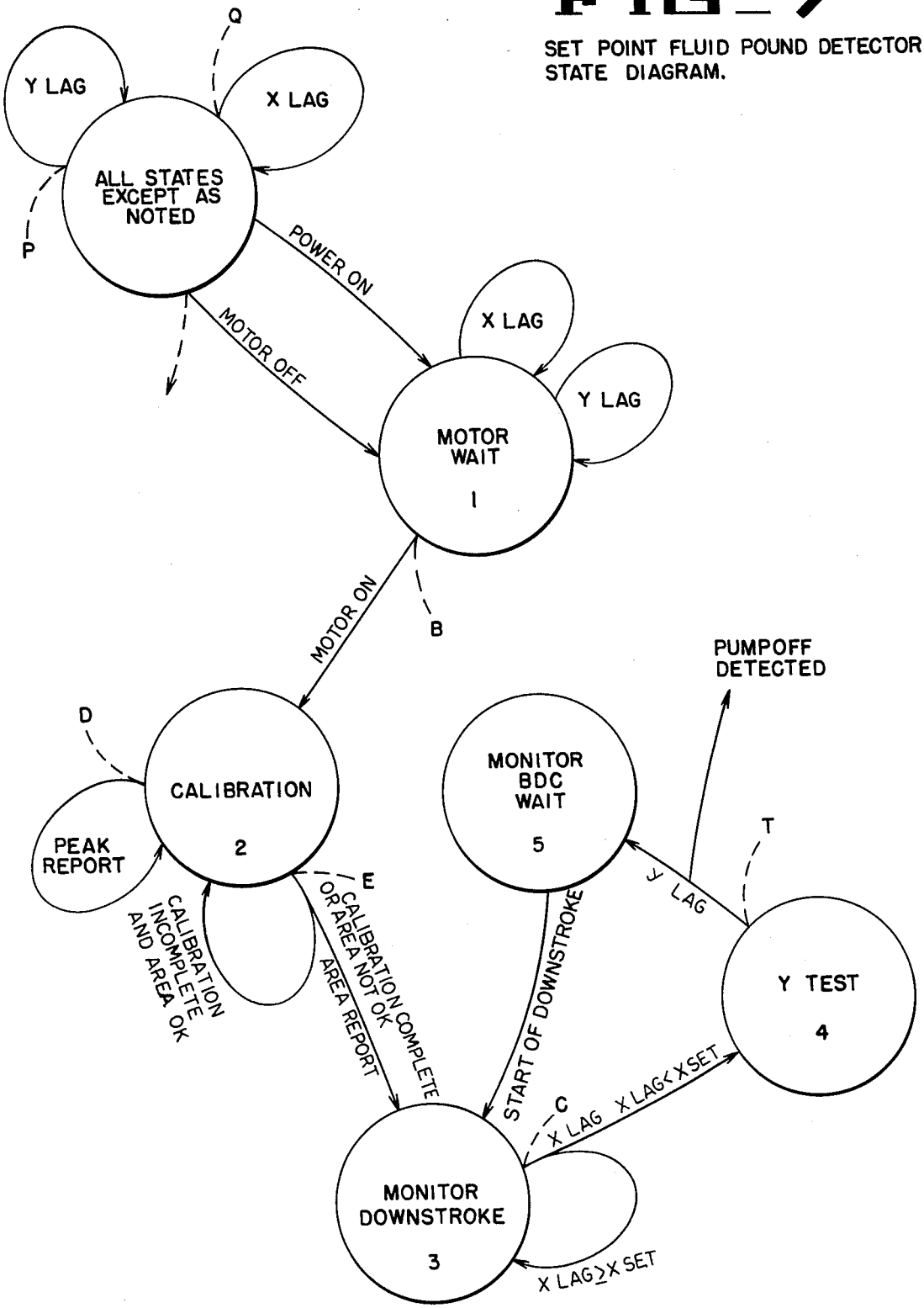
FIG. 7 is a state diagram of a set point fluid pound detector of FIG. 6 used to detect well pump-off.
Figure 8A:
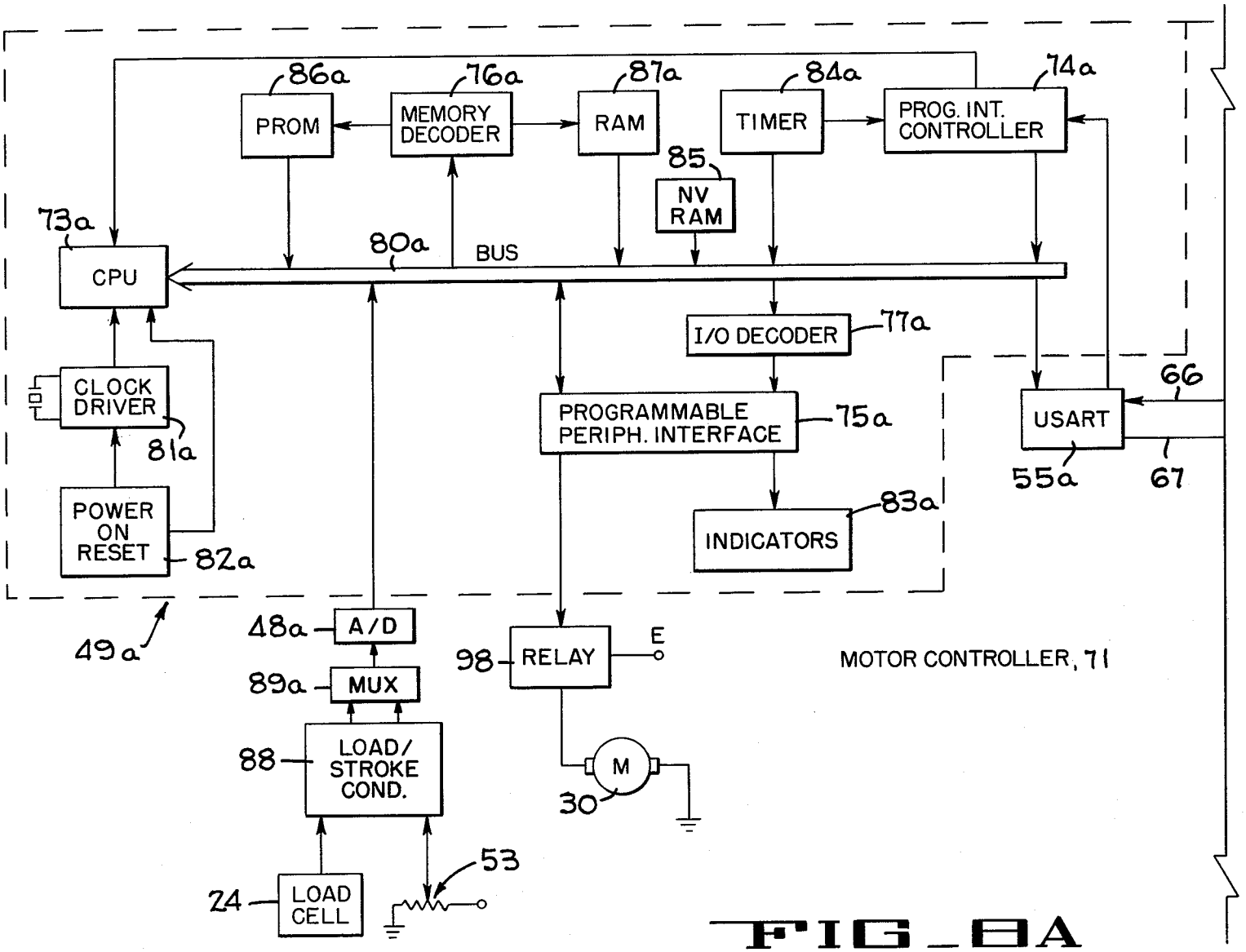
FIGS. 8A, 8B comprise computer circuitry which can be used in the apparatus of FIG. 1.
Figure 8B:
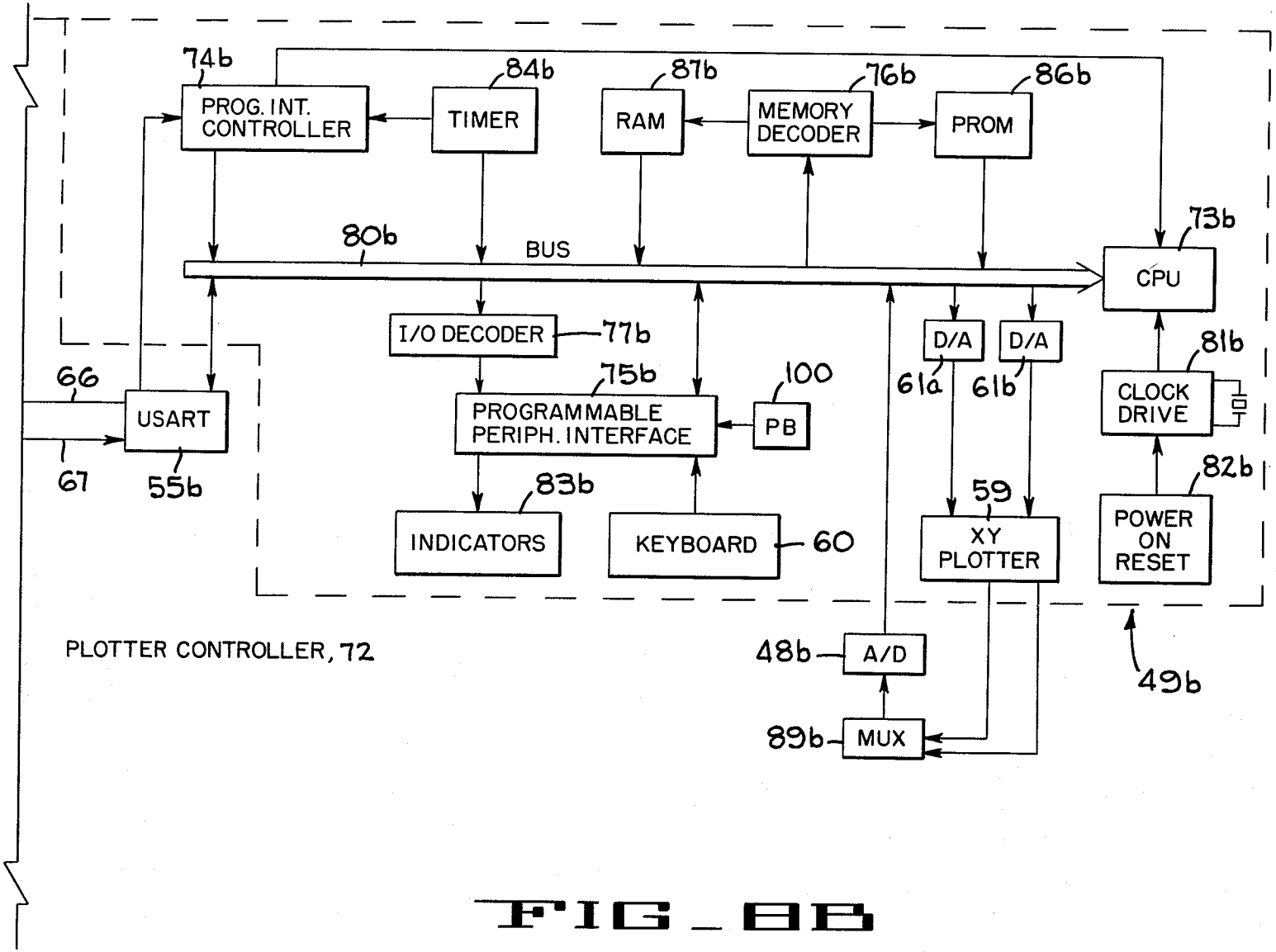

Details of a method and apparatus for automatic calibration of a well and for monitoring operation thereof are disclosed in FIGS. 6–8A and 8B. When FIGS. 8A, 8B are placed side-by-side with leads from the right side of sheet 8A extending to corresponding leads from the left side of sheet 8B the two sheets comprise a block diagram of an embodiment of the computers 49*a*, 49*b* (FIG. 1).

The portion of the computer system disclosed in FIG. 8A comprises a motor controller 71 for receiving signals from the load cell 24 and from transducer 53 and for using these signals to determine the sequence for controlling the motor 30. The computer 49*b* disclosed in FIG. 8B comprises a plotter controller 72 for using the load cell and transducer signals transmitted from computer 49*a* to operate the XY plotter 59. Signals are interchanged between the motor controller 71 and the plotter controller 72 over the pair of interconnecting wires 66, 67.

Each of the controllers 71, 72 includes a central processor 73*a*, 73*b*, a programmable interrupt controller 74*a*, 74*b*, a programmable peripheral interface 75*a*, 75*b* and a memory decoder 76*a*, 76*b* connected for the interchange of information and instructions over a system bus 80*a*, 80*b*. A central processor 73*a*, 73*b* which can be used in the present invention is the model 8088 manufactured by Intel Corporation, Santa Clara, Calif. A programmable peripheral interface 75*a*, 75*b* which can be used is the model 8255A and a programmable interrupt controller 74*a*, 74*b* which can be used is the model 8259A both manufactured by Intel Corporation. An input/output decoder 77*a*, 77*b* decodes address signals for selectively enabling the peripheral interfaces 75*a*, 75*b* to send and receive information from the system bus 80*a*, 80*b*.

Clock pulses for driving the central processors 73*a*, 73*b* are provided by a pair of clock drivers 81*a*, 81*b* which are initialized by a pair of "power on reset" generators 82*a*, 82*b*. The generator 82*a* also includes a power fail circuit to warn that power to the controller is failing. A clock driver 81*a*, 81*b* which can be used in the present invention is the model 8284A manufactured by Intel Corporation. A pair of indicating devices 83*a*, 83*b* provide visual display of information from the peripheral interfaces 75*a*, 75*b*. The indicating device 83*a* also includes a plurality of switches for entering information into the motor controller. A pair of timers 84*a*, 84*b* provide timing signals to operate the controllers 74*a*, 74*b* and information is transferred between the motor controller 71 and the plotter controller 72 by the pair of universal synchronous asychronous receiver transmitters (USARTs) 55*a*, 55*b*. One such USART which can be used in the present invention is the model 8251A manufactured by Intel Corporation. Programs for operating the motor controller 71 and the plotter controller 72 are stored in a PROM 86*a*, 86*b* and data for use in the system is stored in a RAM 87*a*, 87*b*. Data to be retained during a power failure can be stored in a nonvolatile RAM 85. A load/stroke conditioner 88 (FIG. 8A) amplifies and filters signals transmitted from the load cell 24 and the transducer 53 and sends the smoothed signals to the bus 80*a* through a multiplexer 89*a* and the analog-to-digital converter 48*a*. A pair of digital-to-analog converters 61*a*, 61*b* (FIG. 8B) provide analog signals to operate the XY plotter 59 in response to digital signals on the system bus 80*b*. A multiplexer 89*b* and the analog-to-digital converter 48*b* provide digital signals which correspond to the X and Y positions of the plotter 59. An analog-to-digital converter which can be used is the model AD574A manufactured by Analog Devices.

The general operation of a first method for detecting pump-off using apparatus of the present invention has been described in connection with FIGS. 1–4. A detailed description of the selection of the set point (Xset, Yset) and the method of using the motor controller 71 and the plotter controller 72 to determine when the well is in fluid pound will be described in connection with FIGS. 5–22 which provide background of the use of software state machines and of their use in operating the apparatus of FIGS. 1, 8A and 8B and provides details of the operation of a computer program in carrying out various operations performed by the computer of FIGS. 8A, 8B.

The program of the present computer is supported by a real time operating system having various routines that are not applications oriented and that are designed specifically to support programs designed with the state machine concept, that is, a state, input driven program. Some of the routines are sub-routines while others form a module that creates a simple real-time environment under which software state machines can operate. The operating system provides equipment in which a collection of software state machines can operate.

Figures 9, 10:
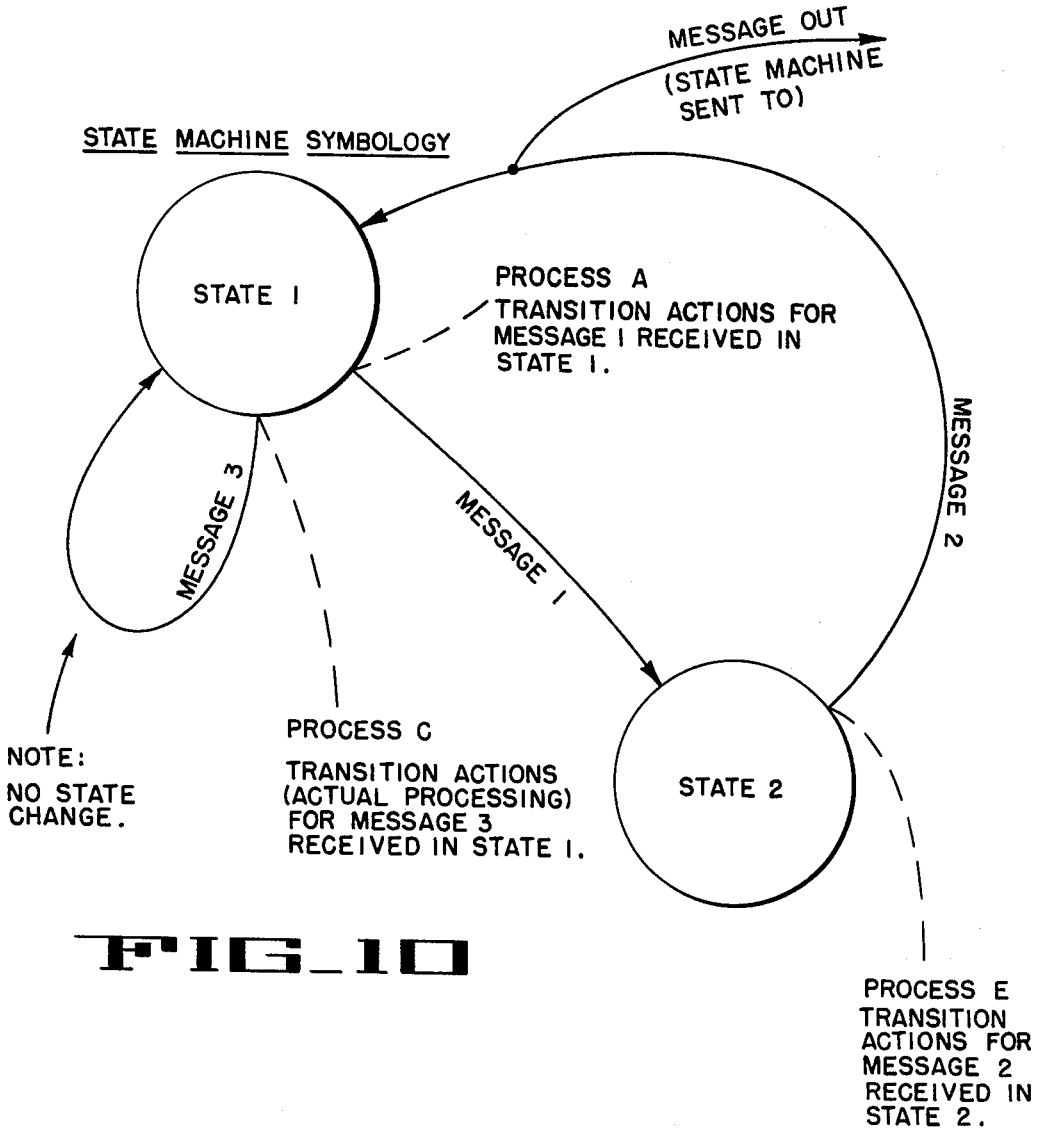
FIG. 9 is a matrix diagram illustrating the operation of software state machines used in the present invention.
FIG. 10 is a diagram illustrating symbology of a typical software state machine used in the present invention.

A software state machine is a process that is executed on the digital computer each time that a message is sent to the state machine. The process does not execute in exactly the same way each time that a like message is sent to it because the processing to be done for any message depends on the machine's "state", i.e., its memory of all prior processing that it has done in response to the previous messages. The state can be any length, from eight binary digits to several thousand binary digits depending upon the complexity of a given machine. Given the state of the machine and the current message, the machine will do a given set of processing which is totally predictable. A machine can be represented as a matrix of processes, indexed by a state and a message as shown in FIG. 9. For example, if the state machine of FIG. 9 receives message number one in state one, then process A will be done. If process A were to cause the state to be changed to state 2 then a second message number one, coming right after the first message would cause process D to occur which could cause the machine to change to state 3. It is not necessary that a process cause the state to change, although it may do so in many cases.

A software state machine, upon completing its process defined by the state and by the message returns control to the program that called it, the state machine scheduler which will be described below. During the given process, the machine is not interrupted in order to give processing time to another machine of the same system. Thus, processing time appointment between a given machine and any of its contemporaries in the system is on a message-by-message basis, and such an environment is called a message switched operating system (MSOS). None of the machine's processes are ever suspended for the processes of another machine. For example, if message three comes in state one, process C will begin and end before another state machine can have the central processing unit (CPU) 73*a* (FIG. 8A) to respond to its next message in its given state.

Certain things can cause a state machine process to "suspend". For example, an asychronous interrupt can be registered and processed. A requirement of the operating environment is that such hardware events are turned into software messages to be processed in order by the responsible state machine. Only that processing that must be done at the exact instant of the interrupt is done and then the interrupt service process will cause a software flag to be raised, ending the interrupt process. When the operating system notes an asychronous flag (semaphore), it generates the needed software message to be sent to the state machine that will carry out the non-time-critical segment of the interrupt processing. An example of such a process is data collection at precisely timed intervals. When the timer interrupt signals that data must be collected, it is read in the required manner dependent on the type of the data, queued in a storage area for processing at a later time, and a flag is raised. When this raised flag is noted by the operating system, a software message is generated, the data is stored and the state machine that is responsible for the processing of this data receives the message at a later time.

A state machine is not given access to the processor by the operating system on a regularly timed basis but is connected to the processor only in order for it to process a message. Whenever the processing of a message is completed the state machine must insure that it will get another message at some point in the future. This is done in the following ways:

(1) Another machine sends a message for synchronizing purposes.

(2) A time period elapses signaled by a timer message.

(3) Real-time data becomes available from some queue.

(4) An input which is being polled, achieves the desired state, and initiates the software message.

(5) An interrupt is sensed and a software message is sent to inform the state machine about this event.

The only time that a machine cannot take care of itself is prior to receiving its first message, so the operating system takes the responsibility of initiating the system by sending to all of the software state machines, functioning therein, an initializing message referred to herein as a "power on" message. No matter what the state of the machine it will respond with a predetermined given process when this message is received independent of the state of the machine.

A convenient means of illustrating the operation of a software state machine is shown in the state machine symbology of FIG. 10 using the messages of FIG. 9 to do some of the processes and to move into some of the states shown in FIG. 9. If we assume the machine (FIG. 10) to be initially in state one, the receipt of message one causes process A to be performed as the transition action for message one received in state one and also causes the machine to move into state two. In state two the receipt of message two causes process E, causes a message to be sent out to another state machine and moves this state machine back into state one. In state one the receipt of message three causes process C as the transition action for receiving message three in state one but does not cause any change in the state of the machine. Some of the other states and processes shown in FIG. 9 are not repeated in FIG. 10 in order to simplify the drawing.

Figure 11:
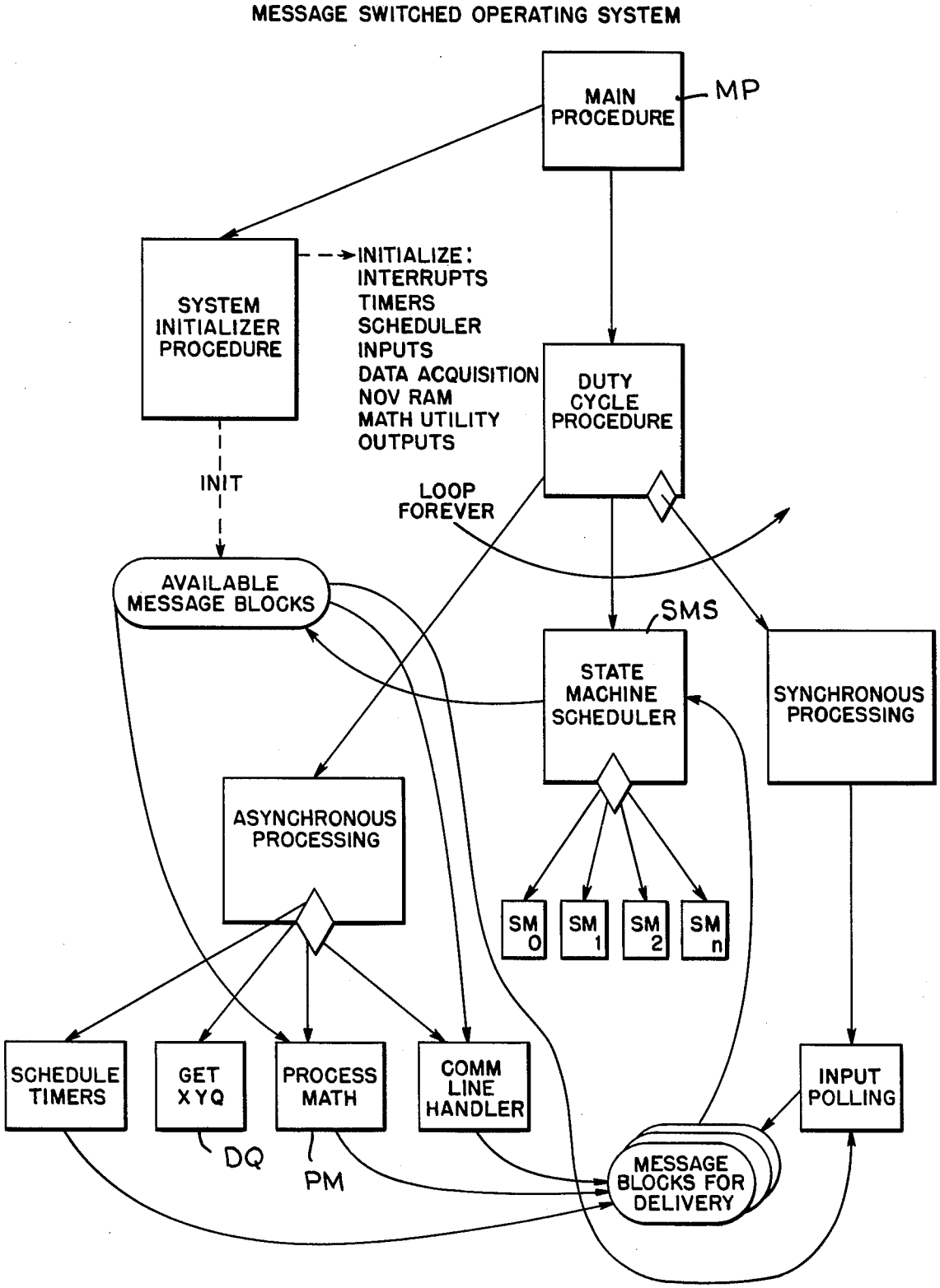
FIG. 11 illustrates a message switched software operating system of the present invention.
Figure 13:
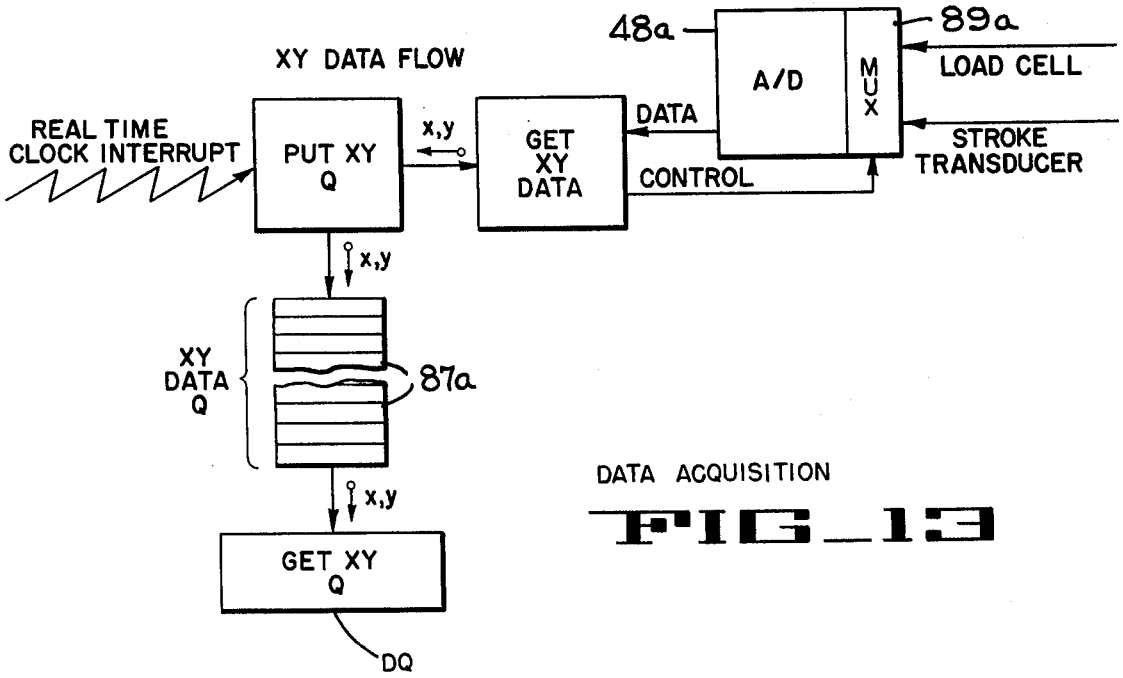
FIGS. 13 and 14 illustrate the flow of data through the operating system and math utility of the present invention.

A message switched operating system of the type shown in FIG. 11 includes a main procedure which provides signals to initialize the system through a system initializing procedure and includes the initialization of various interrupts, timers, the scheduler, inputs, data acquisition, the nonvolatile RAMs, the math utility and outputs as well as initializing the available message blocks so that all dynamic memory is put into an available space queue for storing data. The procedure then calls the duty cycle procedure which sequentially calls the asynchronous processing, state machine scheduler and synchronous processing over and over again. All interrupt programs communicate with the duty cycle program by way of semaphores. The duty cycle program runs indefinitely with a state machine message delivery, an asychronous operation and all synchronous operations timed by the real-time clock for each cycle of the loop. Asychronous operations that can occur are: data input from a real-time data acquisition queue and communication line interrupts to move characters in and out of the system. In the asychronous operation significant events occurring cause an available message block to be secured and turned into a message to be delivered to whatever state machine is charged with processing the particular interrupt. Since the data is queued at the time of acquisition, the transfer operation is asynchronous. If the data processing falls behind the data input, the system can use the time between synchronous clock ticks to catch up on the required operation. Details of the data flow in the asynchronous processing of the DQ block of FIG. 11 are shown in FIG. 13. Signals from the load cell 24 and the stroke transducer 53 (FIG. 13) are acquired by the GET XY data procedure and are transferred into the XY data Q in RAM 87*a* (FIG. 8A) by the PUT XY Q procedure in resonse to a real-time clock interrupt and are removed by the GET XY Q procedure.

Once the data has been acquired it is processed by the math utility (at PM, FIG. 11). The math utility accesses the raw values of stroke (X) and load (Y) and smoothes the values of X and Y. The smoothed value of X ($\overline{X}$) (FIG. 14) and the smoothed value of Y ($\overline{Y}$) are tained by using a moving average smoothing technique where the last n values of X (or Y) received are added and divided by the number of values (n) to obtain a first smoothed value. To obtain the next smoothed value, $\overline{X}$, the newest value is included in the sum, but the oldest received value is not included.

The first derivative, $\overline{X}'$ is then computed and $\overline{X}$ is corrected for the time lag introduced by the computation of the first derivative to obtain the result $\overline{X}$lag. The values of $\overline{X}'$, $\overline{X}$lag, $\overline{Y}'$ and $\overline{Y}$lag are then sent to all state machines that have signed up for these values using the "send message" procedure (FIG. 12) to place the messages on the queue of messages to be delivered.

The first derivative is computed using a method developed by A. Savitzky and M. Golay and described in detail on pages 1627–1638 of the July 1964 issue of "Analytical Chemistry" magazine. This method uses a least squares quadratic polynominal fit of an odd number of points and a corresponding set of convolution integers to evaluate the central point. The derivative computed corresponds to the value at the midpoint of a window of equally spaced observations. The value obtained is identical to the best fit of the observed values to the quadratic polynominal $A_2X^2+A_1X+A_0=y.A_2$, $A_1$, and $A_0$ are selected such that when each X (for the number of points in the window) is substituted into this equation, the square of the differences between the computed values, y, and the observed number is a minimum for the total number of observations (window size). Once $A_2$, $A_1$ and $A_0$ are found the central point is evaluated. The Savitzky - Golay method uses a set of convoluting integers and the observed data points to evaluate the central point.

Figure 14:
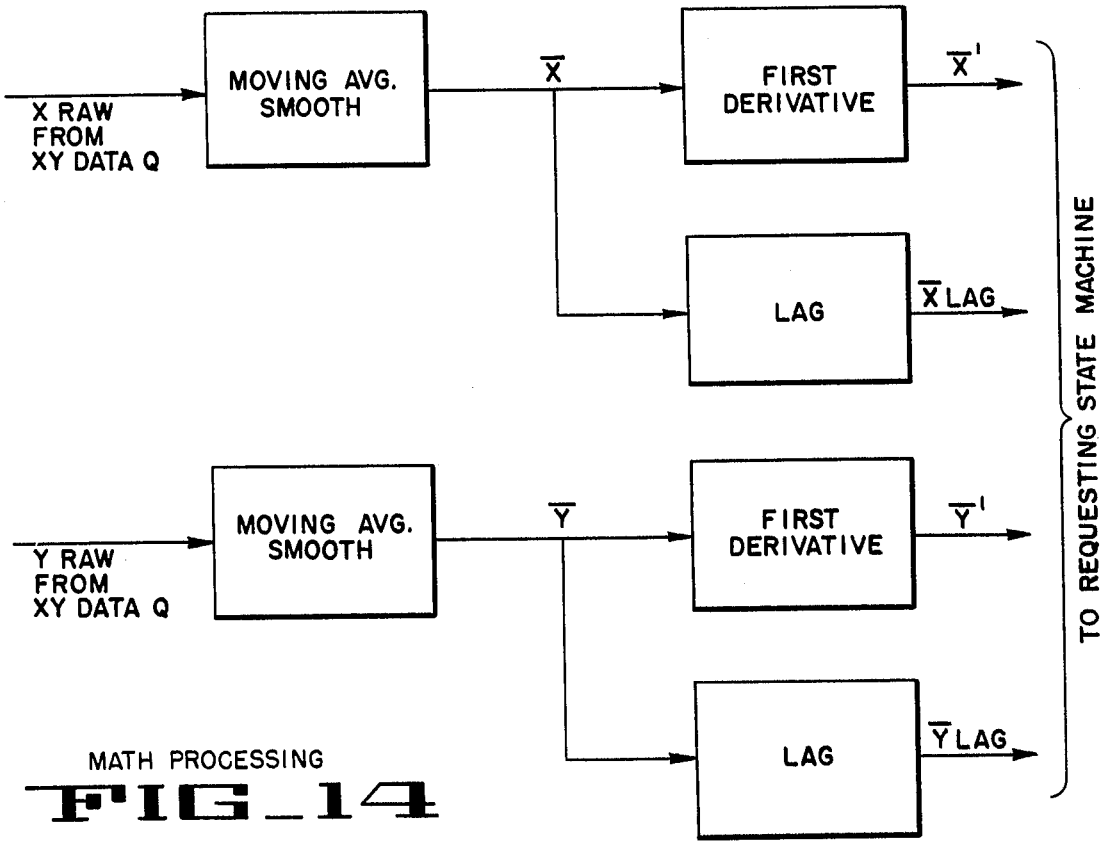

Since the derivative is evaluated at the center of the set of data a lag equal to the (window size $-1$) divided by 2 is introduced. Details of the math utility for obtaining values of $\overline{X}'$, $\overline{X}$lag, $\overline{Y}'$ and $\overline{Y}$ lag are shown in FIG. 14.

The synchronous processing performs hardware input polling, timer aging and signal delivery. When an input, requested for polling by any state machine, gets to the desired state such as an off condition, an on condition, above a level or below a level, etc. an available message block is sent as a message to the requesting machine indicating that a given input is in the desired state. The input will no longer be polled until another request is made.

The timer process is slightly different in that the timer queue is made up of message blocks serving as receptacles for the machine requesting the marking of the passage of time and the time of day when the time will be completed. When the time is completed the block is removed from the timer queue and placed on the message delivery queue as a message. Thus, all responsibilities placed on the state machine are accomplished in the operating system by transferring software messages and by the use of real-time flags and queues (semaphores).

Figure 12:
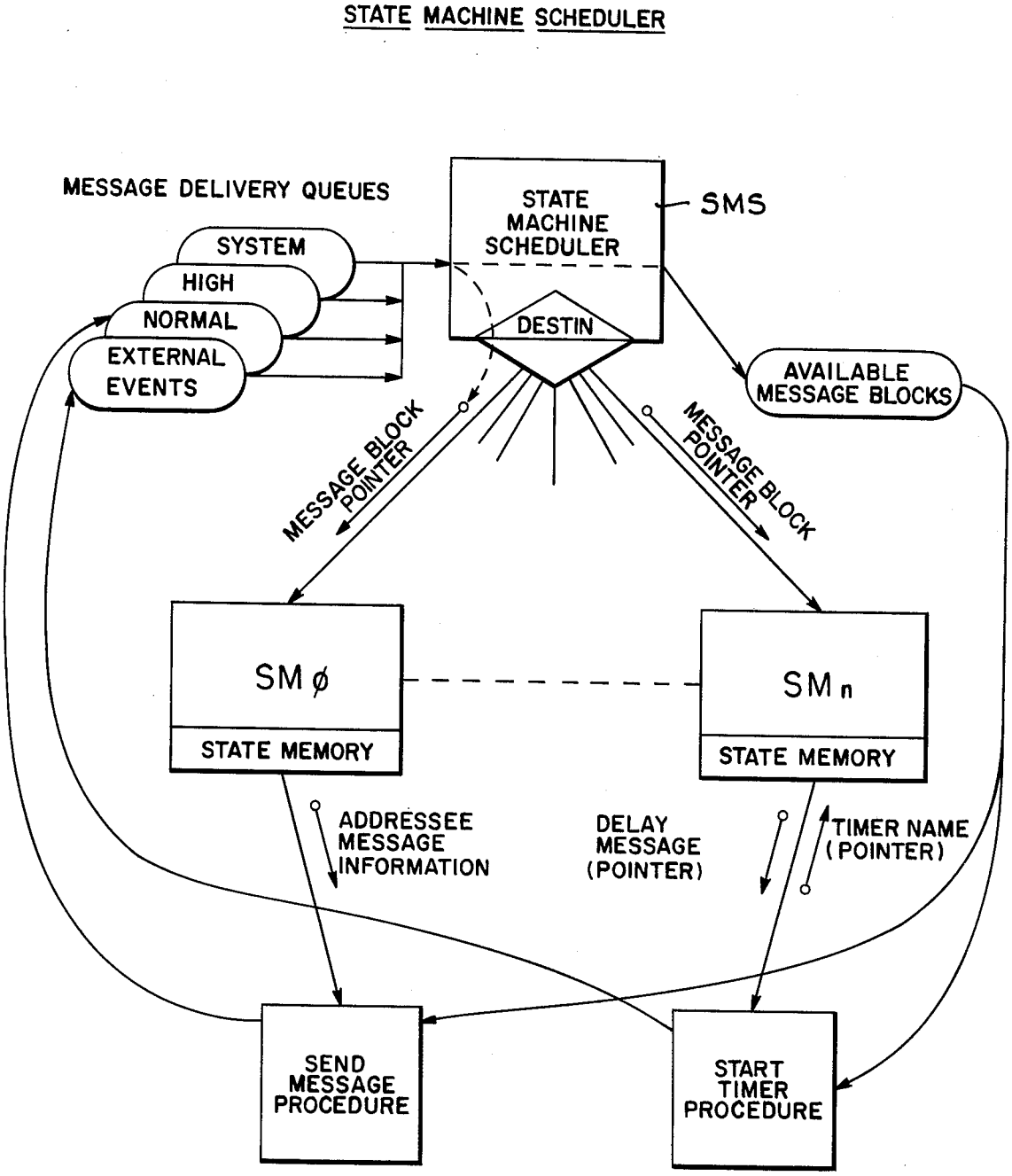
FIG. 12 illustrates a software state machine scheduler of the present invention.

The first component of the operating system (FIG. 11) is a program to deliver a message to a state machine (FIGS. 11, 12). A message is a small block of dynamic memory that is queued for delivery to a designated state machine. This program is called a state machine scheduler and shown in detail in FIG. 12 selects the next highest priority message from the queues of messages ready for delivery. The machine looks up the designation state machine code stored in the message and uses that code to select the proper state machine program to be called with a pointer to the message block as an input. Contained in the program is a state memory. With the memory and the state the proper process can be delivered and executed, and the memory block transferred from the delivery queue to the available space queue for subsequent reuse. Two examples of data that is reused are instructions for sending the messages or setting timers. These processes take available blocks and turn them into messages that will be on the message delivery queue at some later time. Programs such as the message sender and the timer starter are service utilities called by the state machine in order to fulfill the responsibilities alluded to earlier. The state machine scheduler program is the lowest form of the hierarchy which forms the main duty cycle of the operating system. In the diagram of FIG. 11 the relationship of the scheduler to the rest of the operating system is shown.

When power is turned on in the computer of FIGS. 8A, 8B, the power on reset generators 82*a*, 82*b* provides signals which reset various hardware in the computer and cause the first instruction of the computer program stored in the PROM 86*a* to be executed by the central processor 73*a*. A "power on" message is sent, in the manner previously described, to each of the state machine modules 91–94 (FIG. 6) in the computer and these state machine modules are initialized. The load signal values from the load cell 24 (FIG. 8A) and the stroke signal values from the transducer 53 are obtained by the processor 73*a* through conditioner 88 and converter 48*a* and stored in the RAM 87*a* (FIGS. 8A, 13) for use by the stroke discriminator which uses these signals to detect maximum and minimum values of load and rod position. The maximum and minimum values of load and rod position are available to other state machine modules upon request.

Figure 15:
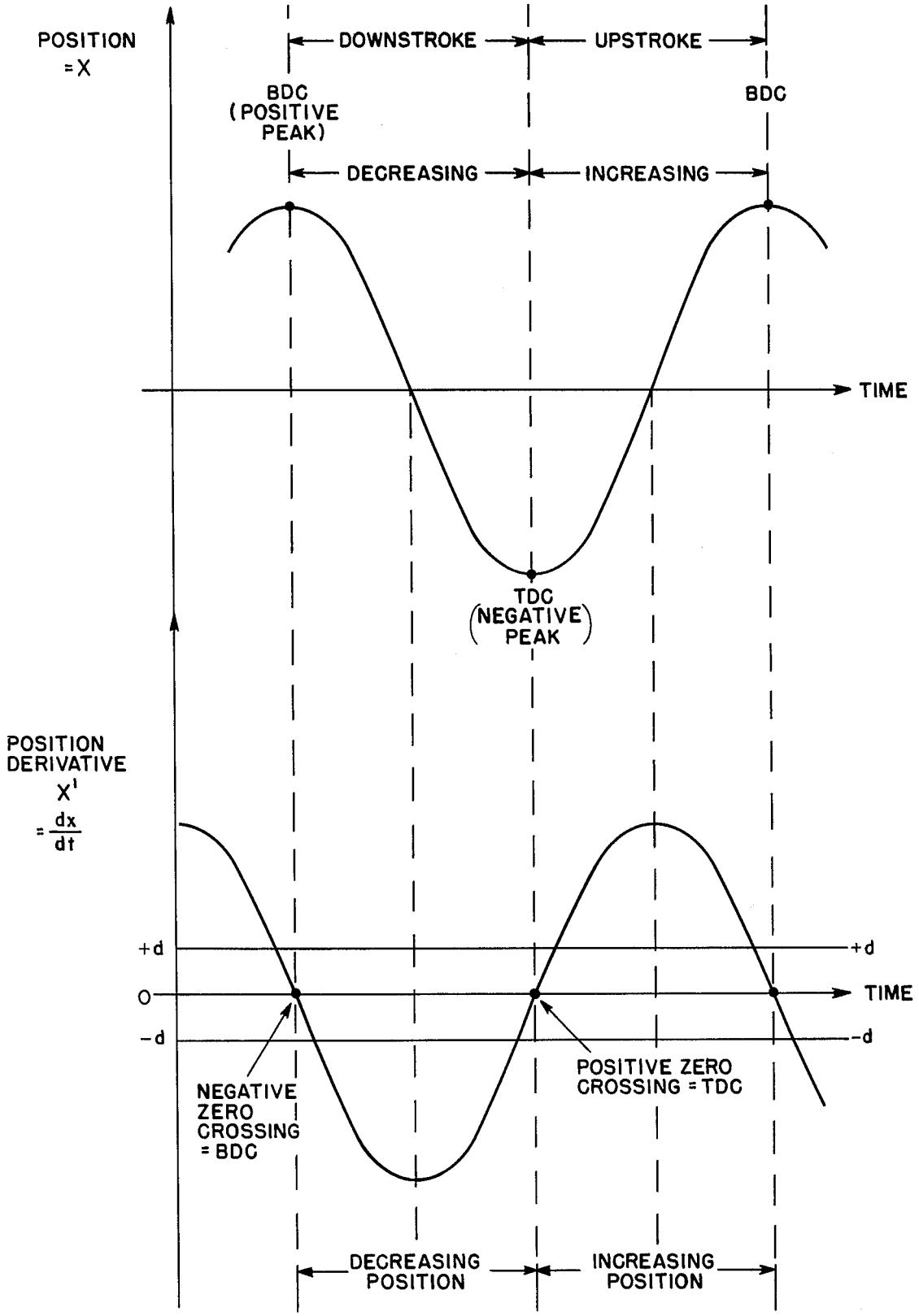
FIG. 15 illustrates typical position and position derivative waveforms in the apparatus of the present invention.
Figure 16:
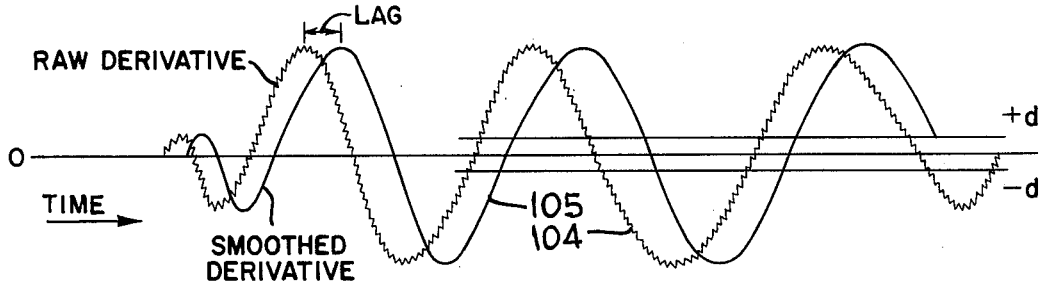
FIG. 16 illustrates the relationship between smoothed (filtered) data signals and noisy (unfiltered) signals and shows signal phase shifts which must be considered in apparatus of the present invention.

The stroke discriminator 93 (FIG. 6) provides signals to the fluid pound detector 92 at the start of the downstroke, at the end of the downstroke and provides peak reports of Xmax, Xmin, Ymax and Ymin and area reports. Details of the stroke discriminator 93 (FIG. 6) and its method of operation are disclosed in FIGS. 15–22 where curve 104 (FIG. 16) shows a typical raw derivative of the rod string 16 (FIG. 1) position vs. time, and curve 105 shows the smoothed derivative of the same. An average of several values of the raw derivative from a timed sequence of values are used in obtaining the smoothed derivative thereby causing a lag between the phase of the smoothed derivative and the raw derivative as shown in FIG. 16. The lagged smoothed derivative is used by a stroke derivative detector 109 (FIG. 17) to obtain the maximum and minimum in the stroke value. Once the max and min values are obtained the system stops looking for another extreme value for a predetermined "blackout time" to reduce the average real processing time consumption by the stroke derivative detector. The blackout time also makes the stroke system more immune to noise in the data input from the stroke transducer 53 (FIG. 1).

There are several software messages that are incoming to the stroke discriminator from the pump-off detection system and from other machines that are not neighbors in the state machine hierarchy. These messages include a "power on" message common to all machines, start and stop messages from other machines which ask for a report of the stroke low point, note of the stroke high point, peak reports of X and Y (stroke and load extremes), and area reports. The Xlag, Ylag and X derivative messages are received from the math utility.

The stroke discriminator 93 (FIG. 17) communicates directly with the pump manager 91 and with the subservient stroke derivative detector 109, a stroke area calculator 110, a stroke extremes detector 111 and other state machines 112. The stroke extremes detector 111 uses the raw values of signal from the load cell 24 (FIG. 1) and the position transducer 53 to find the Xmax, Xmin, Ymax and Ymin. The area calculator 110 integrates the area of the dynagraph (FIG. 2), and the stroke discriminator 93 directs the operation of the other state machines 109–112 shown in FIG. 17.

After the pump manager 91 (FIG. 17) turns on the motor 30 (FIG. 1) a motor on message and a start BDC (bottom dead center) report message (i.e., a signup for start of downstroke report) (FIG. 17) are sent to the stroke discriminator 93. The stroke discriminator waits 3 seconds to allow the stroke signal to stabilize and sends a start message to the state machines 109–111 to monitor the well operation. If a fluid pound is detected during the monitoring operation an alarm signal is sent to the pump manager 91 who turns off the motor and provides a motor off signal to the stroke discriminator.

When the stroke discriminator 93 receives a motor on signal from the pump manager 91, it provides a start signal which causes the stroke derivative detector 109 to measure stroke derivative signal noise during a 3 second turn-on delay period. At the end of the 3 second delay the derivative detector 109 uses the measured noise and the stroke signals to provide upstroke and downstroke signals until the stroke discriminator 93 sends a stop message to the derivative detector.

The stroke extremes detector 111 (FIG. 17) provides a min stroke position, load at min stroke, max stroke position, load at max stroke; min load, stroke position at min load, max load, and stroke position at max load each time a status request is received from the stroke discriminator 93. At the time the status request is received a reset occurs and the calculation of a new set of extreme values is started. This process continues until a stop signal is received by the stroke extremes detector 111 from the stroke discriminator 93.

When the stroke area calculator 110 (FIG. 17) receives a start signal from the stroke discriminator 93 the area calculator receives downside and extreme reports which are used to calculate area of the dynagraph (FIG. 2). The calculated value of the area is sent from the area calculator 110 to the stroke discriminator 93 in response to a status-request signal.

When a power on signal is received by the stroke discriminator (at A, FIG. 18) its memory is initialized and mailing lists of the the state machines which want to receive reports are prepared. When the motor on signal at B is received from the pump manager the stroke discriminator (FIG. 18) moves from the motor off state to the motor starting state, starts a 3 second timer and sends a start X' noise measure message to the derivative detector to start its measurement of the noise on the stroke derivative during this 3 second period. When the 3 second motor on delay timer has expired (at C) the derivative detector 109 (FIG. 17), stroke area calculator 110 and stroke extremes detector 111 receive start messages and the BDC count is set to zero. The BDC position is the bottom dead center of the left end of the walking beam 22 (FIG. 1) and corresponds to the start of the downstroke of the sucker-rod string 16. A start report signal (at G, FIG. 18) from any of the state machines places the requesting machine on the specified mailing list if it is not already there. A stop report signal (at F) from any of the state machines removes the requesting machine from the specified mailing list.

Figure 17:
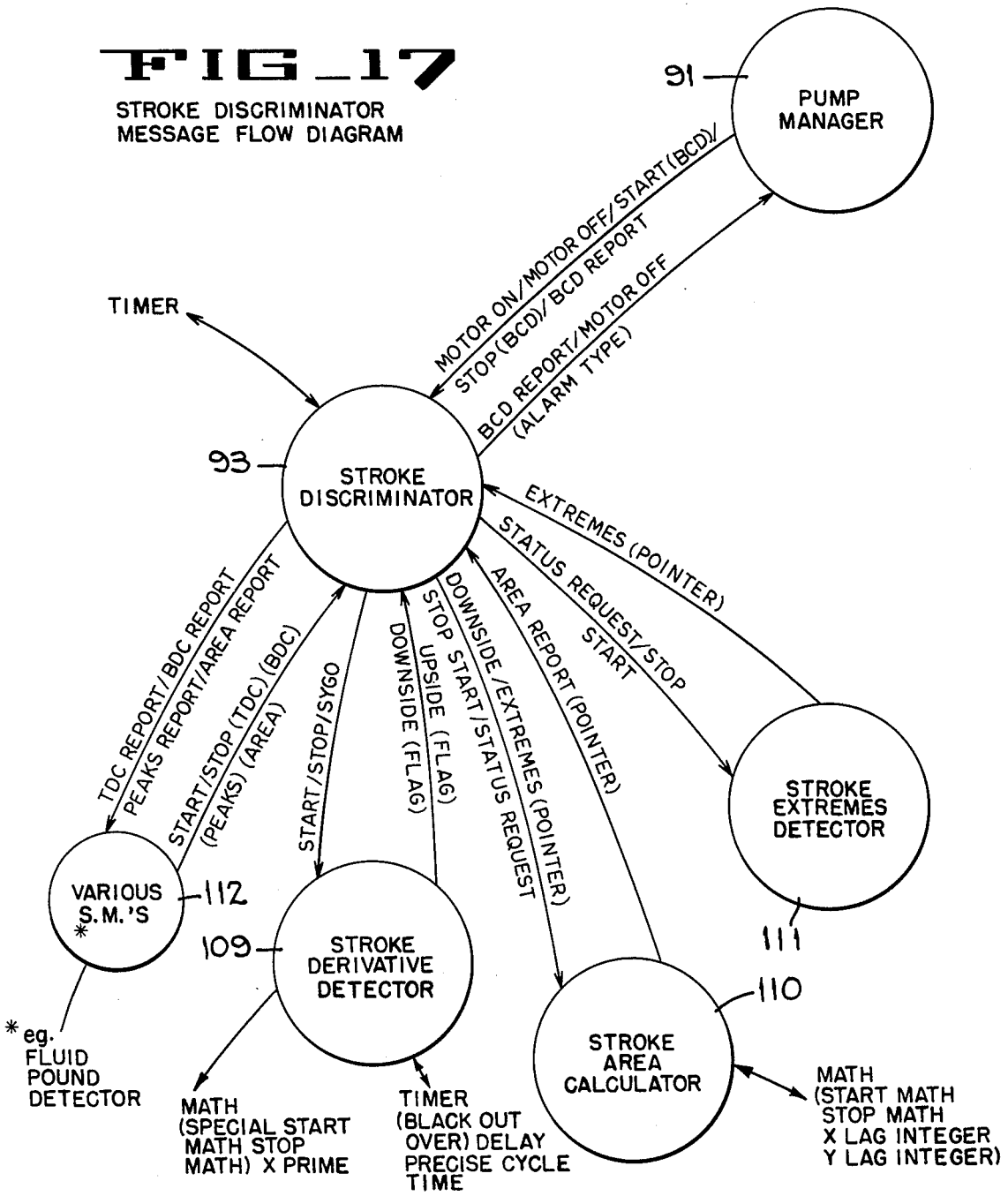
FIG. 17 is a message flow diagram of a stroke discriminator of the present invention.
Figure 18:
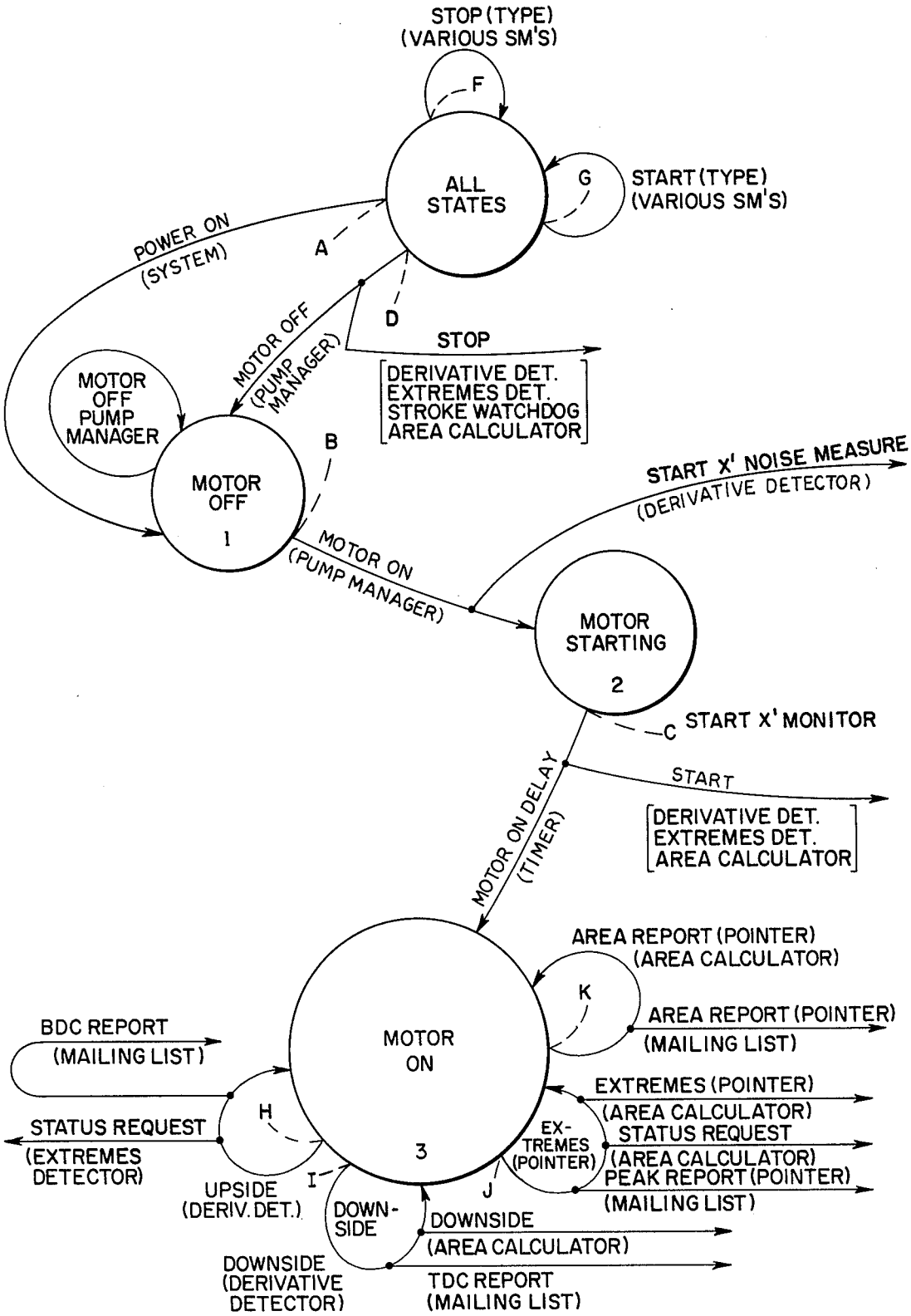
FIG. 18 is a software state diagram of the stroke discriminator of the present invention.
Figure 19:
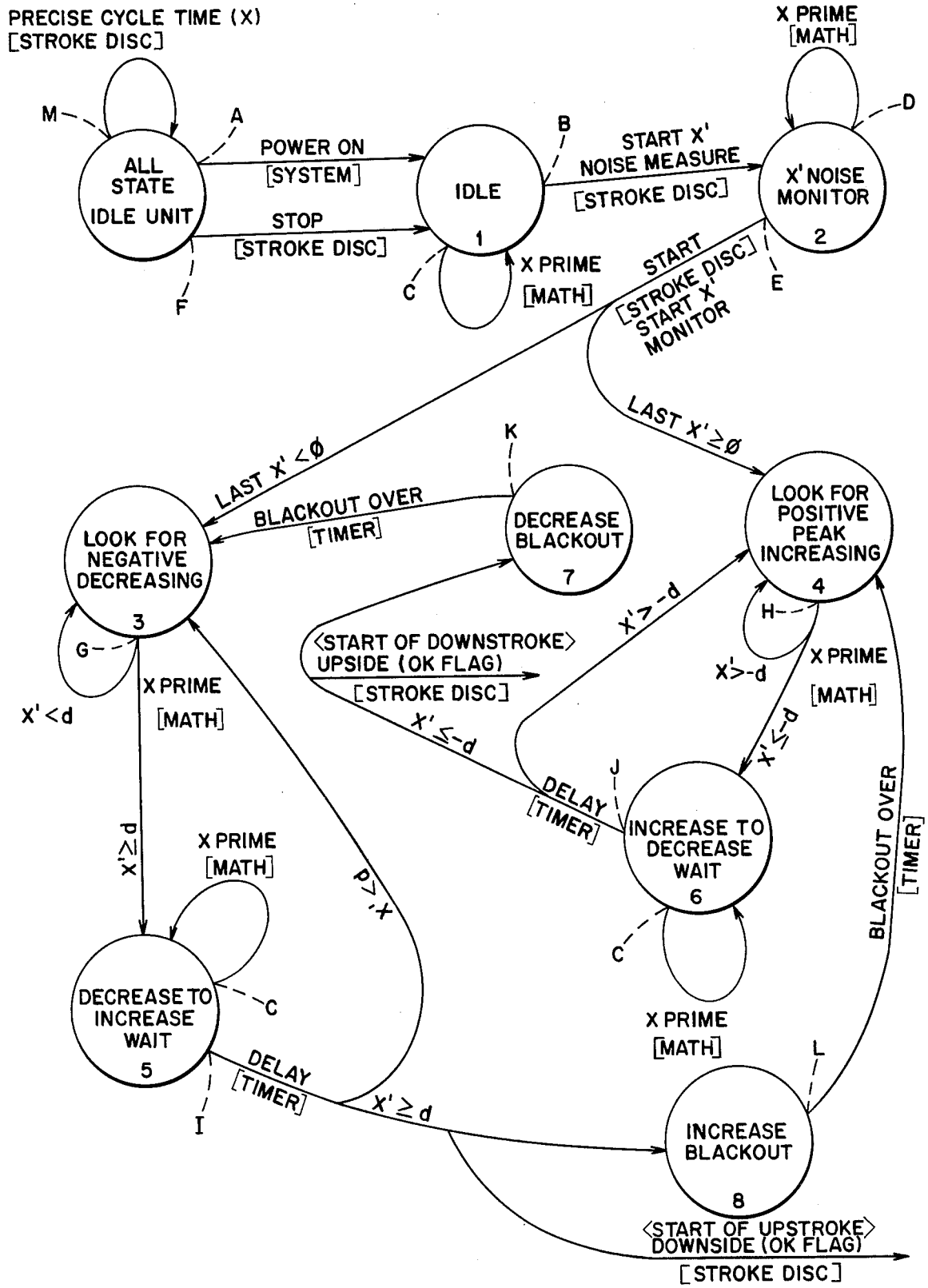
FIG. 19 is a software state diagram of a stroke derivative detector of the present invention.

When an upside signal (at H, FIG. 18) is received from the derivative detector, in the motor on state, if the BDC count is less than 2 the BDC count is incremented. A status request is sent to the extremes detector 111 (FIG. 17) and a BDC report is sent to all machines who have signed up via a start BDC report message as previously noted. When a downside signal (I, FIG. 18)

is received from the derivative detector in the motor on state a TDC or top dead center relative to the outer end of the walking beam report is sent to all who have signed up for such a report. A downside message is also sent to the stroke area calculator 110 (FIG. 17). When an extremes message (J, FIG. 18) is received from the stroke extremes detector 111 (FIG. 17) in the motor on state an extremes message is sent to the stroke area calculator, a status request is sent to the stroke area calculator, and a peak report is sent to all of the state machines who have signed up if the BDC count is at least 2. When an area report (at K, FIG. 18) is received from the area calculator in the motor on state an area report is sent to all state machines who have signed up if the BDC count is at least 2.

The stroke derivative detector 109 (FIG. 17) identifies the maximum and minimum stroke positions by using the zero crossing of the first derivative of the stroke signal (FIG. 15) from the stroke transducer 53 (FIG. 1). The first step in the operation is to determine a dead band or noise band about the zero crossing value (X′=0) as seen in FIGS. 15 and 16. A noise value "d" is a maximum difference between X′ from the math utility and the X′ smoothed by a fifteen point moving average, detected during the 3 second monitor period and corrected for phase shift. The noise band is used to declare that a top dead center (TDC) position has been reached when X′ is greater than +d and a bottom dead center (BDC) position has been reached when X′ is less than −d. The operation of the stroke derivative detector 109 (FIG. 17) is disclosed in detail in the state diagram of FIG. 19. When the system provides a power on signal (at A, FIG. 19) the derivative detector is initialized and requests a report of X′ from the math utility 94 (FIG. 6). The derivative detector also sets a blackout timer to 2 seconds. At this point a subsequent start X′ noise measurement signal from the stroke discriminator starts the derivative detector (at B, FIG. 19). A fifteen point moving average smooth of X′ is initiated with the last previous value of the derivative used as a starting value and with the maximum noise set to a value of zero.

The start X′ noise measurement message signal (at B, FIG. 19) moves the derivative detector into the X′ noise monitor state (2). When a X value is received from the math utility it is smoothed. The absolute value of the difference between the smoothed and the raw values of X′ is then computed. If this value is greater than the maximum noise value then the maximum noise is set to this value. When a start signal is received from the stroke discriminator (at E, FIG. 19) indicating that the 3 second noise measurement period is over, the X′ zero noise band is set (FIGS. 15 and 16). The maximum noise value is then increased by a 10% safety margin and −d is set to −max noise and +d is set to +max noise (FIG. 16).

If the last X′ value received is greater than zero then the increasing state is entered. If, however, the last X value is less than zero, then the decreasing state is entered. The derivative detector now monitors the X′ values in order to detect the top and bottom of the stroke (FIG. 15).

The operation for the detection of the start of the upstroke (state 3 to 5 to 8 to 4, FIG. 19) is the same (except for the sense of direction) as the operation for the detection of the start of the downstroke which goes from state 4 to 6 to 7 to 3 so only the one detection operations will be discussed herein.

When the stroke derivative detector is in the decreasing state (3, FIG. 19) and a X′ value is received from the math utility the X′ value is checked against the upper end of the noise band +d. If the X′ value is less than +d then no action is taken and the stroke discriminator detector remains in state 3. However, if X′ is greater than +d then the signal has gone through the zero X′ band in an increasing direction and therefore may have detected the negative position peak (TDC or end of downstroke and start of upstroke). However, it is possible that noise has caused a false detection, therefore a 3 point timer (time needed to acquire 3 data points at the data acquisition rate) is started and state 5 (FIG. 19) is entered. X′ values are recorded in this state during the time required to collect the 3 points of data. When this time has expired X′ is again compared to +d and if X′ is less than +d a noise glitch has occurred. The zero noise band between +d and −d is increased by 10% or by a count of one, whichever is greater, and the stroke discriminator detector returns to state 3. If, however, X′ is greater than the value d a negative position peak has been detected. A blackout timer is started, state 8 is entered and a downstroke message is sent to the stroke discriminator 93 (FIG. 17). During the blackout time X′ is not checked. Because of the cyclical nature of the pump stroke another peak is not expected until a known minimum time has passed. The use of the blackout time improves the noise immunity of the detector. When the blackout time has expired, X′ math flow is started again, the increasing state (4) is entered and the system looks for the positive position peak. The process is the same as above except for the sense of the comparison as noted hereinbefore.

Figure 20:
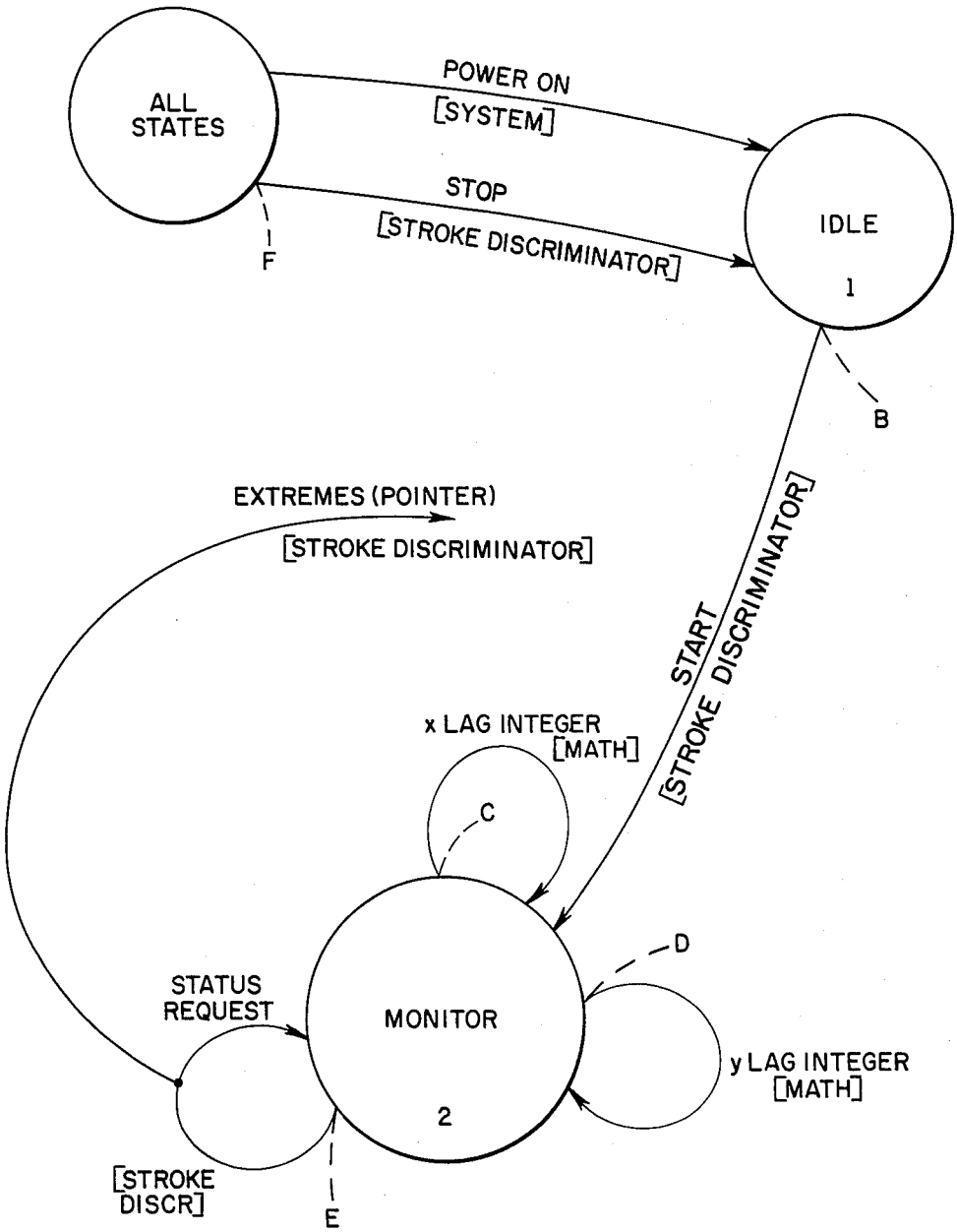
FIG. 20 is a software state diagram of a stroke extremes detector of the present invention.
Figure 21:
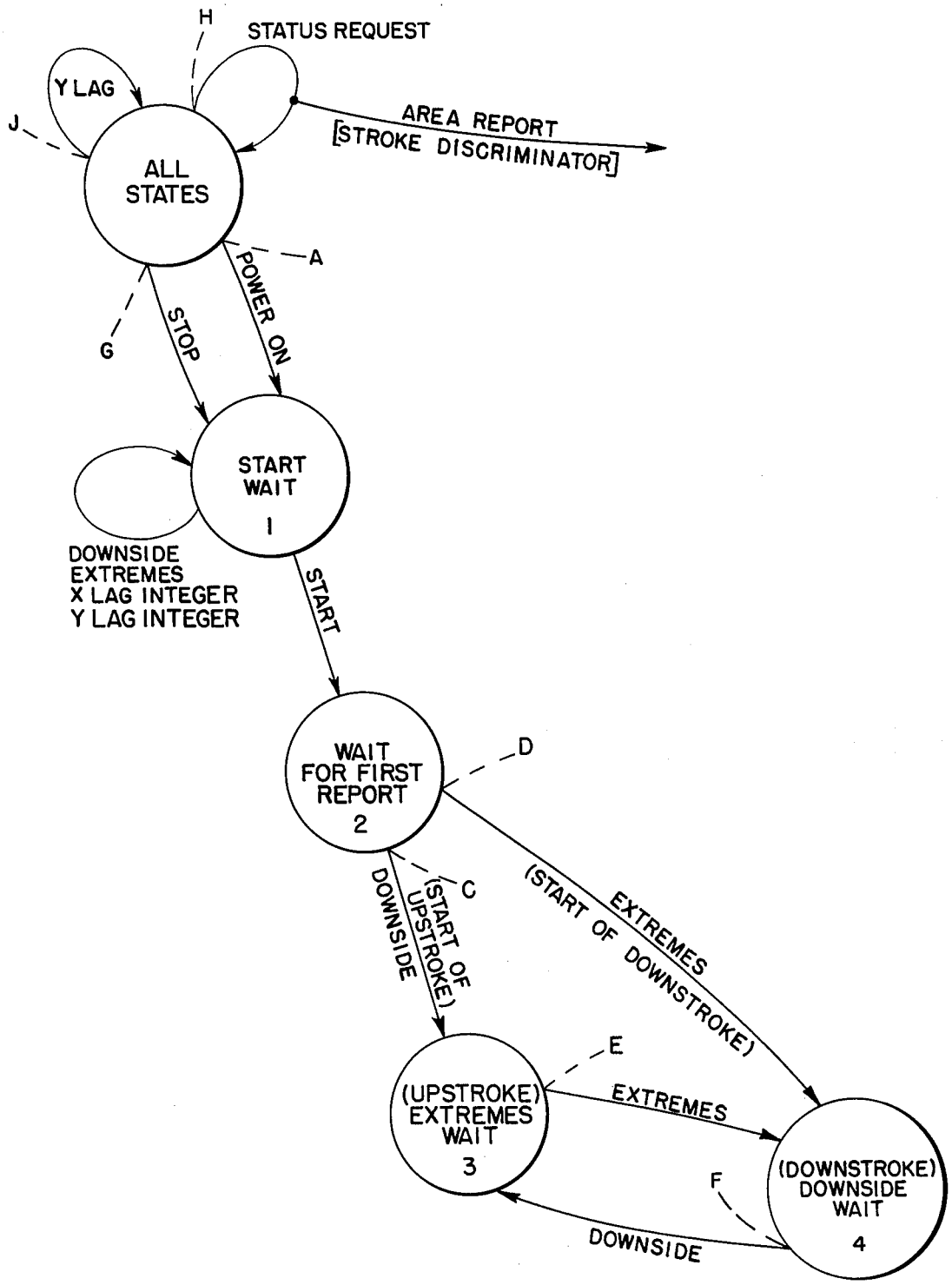
FIG. 21 is a software state diagram of a stroke area calculator of the present invention.

Details of the stroke extremes detector 111 (FIG. 17) which detects Xmax, Xmin, Ymax and Ymin values, is shown in the stroke extremes detector state diagram of FIG. 20. When power is turned on the stroke extremes detector moves into the idle state (1, FIG. 20). In response to a start signal (at B) from the stroke discriminator 93 (FIG. 17) the values Xlag and Ylag math flow are started and the extremes are initialized. In initializing the stroke extremes, Xmin is set to the maximum positive value used in the detector, Y at Xmin is set to the value of zero, Xmax is set to zero and Y at Xmax is set to a value of zero.

The stroke extremes detector (at C, FIG. 20) uses the Xlag signal from the math utility 94 (FIG. 6) to calculate updated values of Xmax and Xmin and uses the Ylag signals (at D, FIG. 20) to calculate the updated values of Ymax and Ymin. The updated values of maximum and minimum for X and Y are calculated as follows. If X received is greater than Xmax then Xmax is set to the X value received and Y at Xmax is set to the corresponding Y value. The same procedure is done for Ymax. If X received is less than Xmin then Xmin is set to the X value received and Y at Xmin is set to the corresponding Y value and the same procedure is followed for Ymin. These values are sent to the stroke discriminator 93 (FIG. 6) in response to a status request (at E, FIG. 20) and the extremes are then initialized.

The stroke area detector 110 (FIG. 17) calculates the total dynagraph card area (FIG. 2) under the direction of the stroke discriminator 93. When a power on message is received (at A, FIG. 21) the status report total curve area is set to a value of zero. When a start message is received from the stroke discriminator the stroke area calculator moves to the "wait for first report state". When a start of upstroke (D) or start of downstroke report (C) is received in the wait for first report state, the appropriate state either 3 or 4 is entered and the parameters are initialized. The buffer index (FIG. 22) and the total area are both set to an initial value of zero and the math flow is started. As the Ylag (load) values are received, these values are processed in the manner determined by the area calculator state (upstroke or downstroke).

Figure 22:
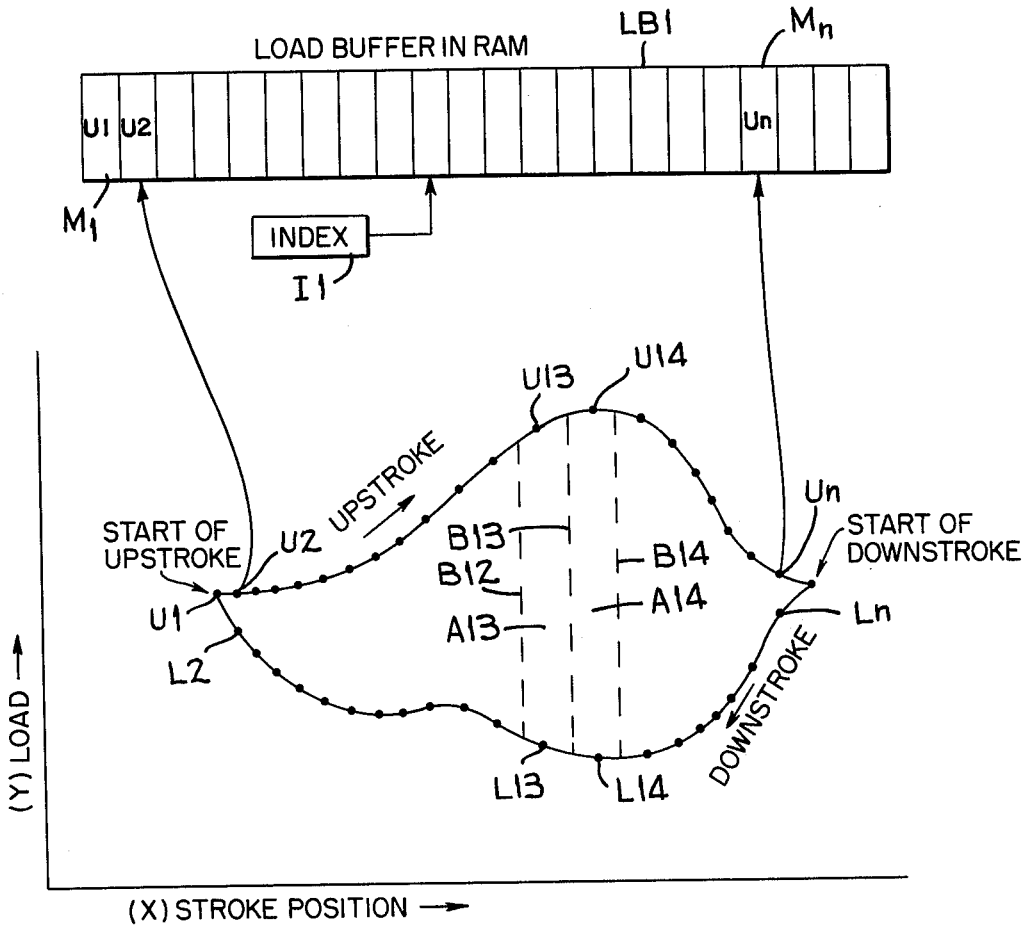
FIG. 22 illustrates a procedure used in calculating the area inside a dynagraph curve for a typical well.

Details of the method and apparatus for calculating the total area of the dynagraph are illustrated in FIG. 22 where the load values Ul–Un are sampled at regular intervals during the upstroke and stored in memory positions Ml–Mn of a load buffer LB1. At the start of each upstroke (FIG. 22) an index I1 is set to zero so it points to memory position M1 of buffer LB1 in the RAM 87*a* (FIG. 8A) and the total area is set to zero. At regular intervals on the upstroke each of the load values Ul–Un are sampled and placed in one of the memory positions Ml–Mn of buffer LB1 under the direction of the index I1. The index is then incremented to the next position.

On the downstroke as each of the new values is received, the index I1 is decremented, each of the lower load values Ln–Ll is subtracted from the corresponding upper load values Un–Ul, stored in buffer LB1 and the difference values are used to calculate the area of the dynagraph by slicing the dynagraph into small vertical strips, calculating the area of each strip and adding these strip areas to obtain the total area. For example, the lower load value L14 (FIG. 22) is subtracted from the corresponding upper load value U14 and multiplied by the width between boundaries B13 and B14 to obtain the area of the strip A14. Since only the relative areas of the dynagraph between different well conditions are needed the width of each strip can be assumed to have the value of 1, even though the widths of the strips vary from one portion of the dynagraph to another. Each strip, such as strip A14 has substantially the same width each time the load values are sampled.

The area strips (FIG. 22) are shown as being relatively wide to simplify the diagram, but a greater number of load samples, resulting in narrower strips, can be used to increase the accuracy of the calculations. When a strip width of one is assumed it is necessary to merely subtract each load value Ll–Ln from the corresponding load value Ul–Un to obtain the area of each strip.

The power on message causes the pump manager software state machine module 91 (FIG. 6) to provide power to the pump motor 30 (FIG. 8A) through interface 75*a* and a motor relay 98. A "power on" message to the set point detector (FIG. 7) moves this state machine into the "motor wait" state. The motor 30 moves the sucker-rod string 16 (FIG. 1) through a predetermined number of start up ignore cycles to allow the fluid level in the well to stabilize, then the pump manager module 91 (FIG. 6) sends a "motor on" message to the fluid pound detector 92 which moves the set point detector (FIG. 7) from the "motor wait" state to the calibration state. At this transition a set of four smoothing buffers (not shown) in the RAM 87*a* (FIG. 8A) are initialized for receiving values of Xmax, Xmin, Ymax and Ymin for smoothing, and the calibration cycle count is set to zero.

The stroke discriminator 93 (FIG. 6) sends a peak report and an area report to the fluid pound detector 92 at the start of each downstroke. The peak report contains values of Xmax, Xmin, Ymax and Ymin. The present invention uses four consecutive cycles of pump operation to obtain smoothed values of the peak values Xmax, Xmin, Ymax and Ymin, although a greater or lesser number of cycles can be used. When an area report is received (at E, FIG. 7) the area is compared with a previously computed area which is stored in the nonvolatile RAM 85 (FIG. 8A).

If the newly computed curve area is equal to or greater than 80% of the previous area, the values of Xset and Yset (FIG. 2) are computed using the latest smoothed values of Xmax, Xmin, Ymax, Ymin and the latest operator entered values of X % and Y % in the formulae:

$$Xset=(Xmax-Xmin)\ (X\ \%\div 100)+Xmin$$

$$Yset=(Ymax-Ymin)\ (Y\ \%\div 100)+Ymin$$

All values of Xset, Yset, Xmax, Xmin, Ymax, Ymin and the dynagraph calibration (card) area are stored in RAM 85 (FIG. 8A) in the event that the area test falls below 80% at a later time. When the calibration count reaches a value of four and the area test has exceeded the 80% test on each of the four cycles the monitor period is started on the next downstroke of the pump rod 16 (FIGS. 1, 7).

If the newly computed curve area is less than 80% of the previous area, the previous values of Xmax, Xmin, Ymax and Ymin are retrieved from their stored position in the RAM 87*a* (FIG. 8A) and used to calculate the values of Xset and Yset (FIG. 2). When Xset and Yset have been obtained, the monitor period (FIG. 7) is started on the next downstroke of the pump rod 28 (FIG. 1) because calibration is not recommended when the area of the dynagraph is reduced.

The above calibration technique permits the set point (Xset, Yset) to be updated to follow slowly changing well conditions, such as a change in fluid level due to water flooding, but prevents the set point from changing due to a pump problem or to a high fluid level resulting from a power outage or from workover of the well. Any sudden change in area of the dynagraph curve would probably be due to pump-off or to pump problems which could further damage pump equipment and such sudden changes should be detected as problems. These problems might not be detected if the set point (Xset, Yset) changed positions relative to the dynagraph.

After the set point detector (FIG. 6) has calibrated itself, it begins to monitor the well for fluid pound during the pump downstroke using the stroke (Xlag) and the load (Ylag) values received from the math utility 94. As each current value (Xc, Yc) is received the last previous value Xl, Yl is stored in the RAM 87*a*(FIG. 8A) and these values Xc, Xl, Yc, Yl are used to interpolate the values between monitored points (FIG. 5) to obtain a true value of Y at Xset. This is necessary as the periodic time sampled checking of the values of X and Y may not obtain a reading exactly at the point Xset. When a current value of X is less than Xset (FIGS. 2–5) the next value of Y (Yc) is used with the previous Y value (Yl) to obtain a value of Y at Xset. If Y at Xset is greater than the value Yset (FIG. 2) a violation count is incremented. When the violation count reaches a predetermined number, a "pump-off detected" signal is sent to the pump manager 91 (FIG. 6).

When the calculated value of Y at Xset is less than or equal to Yset the violation count is set to zero to insure that a specific number of consecutive violations are obtained before the pump-off detected signal is sent to the pump manager (FIG. 6).

Figure 23:
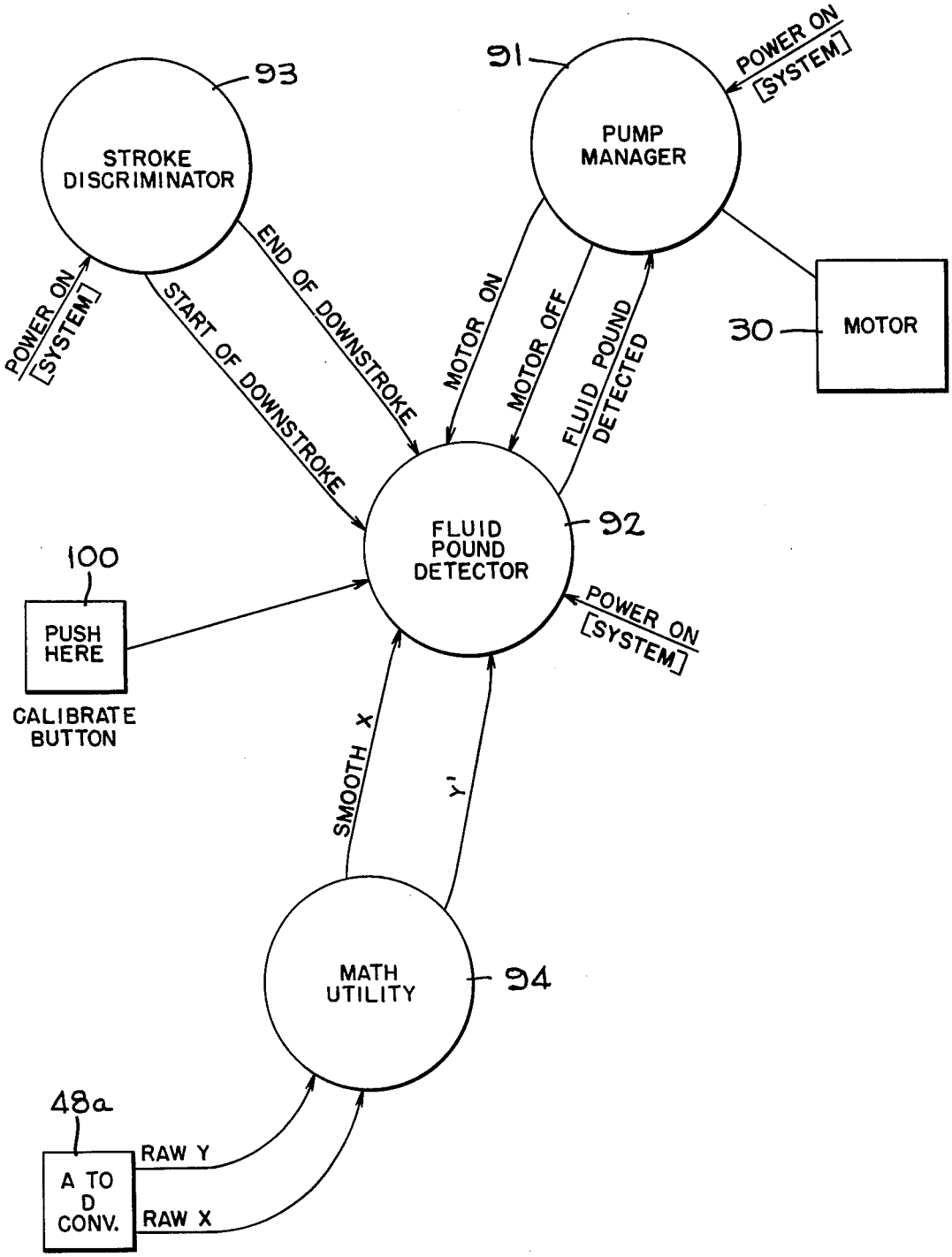
FIG. 23 is a message flow diagram of a second mode of operation of the fluid pound detector of the present invention.

A second method of using the apparatus of FIGS. 1, 8A, 8B for detecting pump-off is disclosed in the message flow diagrams of FIGS. 23 and 24 and in the load curve of FIG. 25. The slope of the load curve between the upper rod string position Xmax and the lower rod string position Xmin is monitored and the position at which the slope of the load curve has the greatest negative value, X(Ypmin) is calculated for each cycle of operation. The direction of movement of this point X(Ypmin) is used to detect fluid pound. As the fluid level in a well decreases, the point X(Ypmin) progressively moves from point X(Ypmin 1) of FIG. 25 to X(Y'min 2) toward point X(Y'min 5). A value of X, called Xset, can be selected and when the point X(Y'min) reaches Xset the motor 30 (FIG. 1) is shut down.

The value Xset is calculated in computer 49*a* (FIG. 1) by first calculating a value Xav which is an average value of X at which X(Y'min) is positioned when the well is filled with fluid. A human operator uses a keyboard 60 (FIGS. 1, 8B) or other input to the computer 49 (FIG. 1) to enter a sensitivity value (percentage) which causes the computer 49 to calculate an Xset value a predetermined percent of the distance between Xmin and Xav (FIG. 25). If the characteristics of the well or its pump, etc. should change so the curve of FIG. 25 changes the computer can be used to recalculate the position of the set point Xset.

When the set point Xset has been selected the computer continually monitors the value X(Y'min) of the curve (FIG. 25) until X(Y'min) reaches the value of Xset as the curve moves from Xmax toward Xmin. If the value of X(Y'min) is less than the value of Xset the computer 49*a* (FIG. 1) provides a signal which causes the motor 30 to stop and the well is shut down. To insure that the well is really pumped-off at this time, it may be desirable to use the average value of X(Y'min) computed over several pumping cycles and to allow the pump to move through two or more cycles with the curve (FIG. 25) to the left of the set point each time, before the motor 30 is turned off. This prevents shut down of the well due to an erratic signal from the load cell 24 or from the transducer 53 or from other electronic equipment or of the well itself.

The operation to detect pump-off using the position of the maximum slope of the load curve is initiated by the power on reset generators 82*a*, 82*b* that provide signals which reset various hardware in the computer and cause the instruction of the computer program stored in the PROM 86*a* to be executed by the central processor 73*a*. A "power on" message is sent to each of the state machine modules 91–94 (FIG. 23) in the computer and these state machine modules are initialized with the fluid pound detector 92 (FIG. 23) going into a motor wait state (FIG. 24).

The power on message causes the pump manager module 91 (FIG. 23) to provide power to the pump motor 30 (FIG. 8A) through a motor relay 98. The motor 30 moves the sucker-rod string 16 (FIG. 1) through a predetermined number of cycles to allow the fluid level in the well to stabilize, then the pump manager module 91 (FIG. 23) sends a "motor on" message to the fluid pound detector module 92.

The fluid pound detector is set in the monitor mode (FIG. 24) where it retrieves the current average value of X (Xav), at the point X(Y'min) (FIG. 25) where the maximum negative slope of the well characteristic curve occurs. This value of Xav is retrieved from a nonvolatile memory used to prevent loss of data if power should be lost in the computer. Prior to the first cycle of calibration the value of Xav is zero. A calibrate button 100 (FIGS. 8B, 9) is armed so that calibration will start when the button is pressed, the cycle count is set to zero, the slope Y'min is set to a value of −1, and Xav at Y'min is set to a value of zero. At the start of the next downstroke the fluid pound detector 92 receives the value Xmin (FIG. 25) from the stroke discriminator 93 (FIG. 23). If Xav is zero, then Xset is set to zero, otherwise the value of Xset is computed from the following formula:

$$Xset=(100-X\ \%)\ (Xav-Xmin)+Xmin,$$

where X % is a percentage value between zero and 100 is selected by a human operator.

Xav is the average value of X where the slope Ypmin of the curve has a maximum negative value.

Xmin is the minimum position of the rod string. The cycle count is incremented.

When the calibrate button 100 (FIGS. 23, 8B) is pressed, the mode is set to calibrate and the cycle count is set to zero (FIG. 24). At the start of each downstroke the value of Ypmin is set at −1. During the downstroke, values of slope of the curve, Y', are received by the fluid pound detector 92 (FIG. 23) from the math utility as previously described and compared with the most negative value of slope previously determined during the current downstroke. If the slope is more negative than the previously determined value the old value of Y' is replaced with the new Y', and the value of X where this more negative slope occurs X(Y'min) is saved and averaged with the previous values to obtain a value of Xav. At the end of the downstroke the cycle count is incremented. When a predetermined number of values of X at Y'min have been used to calculate an average, i.e., when the cycle count has reached the desired number of calibration cycles, the value of Xav is stored in a nonvolatile memory and the mode is set to monitor. This calibration occurs in the downstroke-upstroke loop 101 (FIG. 24). The value of Xset is recomputed using the Xav value just determined, the received value of Xmin and the X % as described above.

In the monitor mode the value of Y'min is initialized to −1 at the start of each downstroke. The values of the slope of the curve Y' are received and compared as before, to the most negative value of the slope previously received during the current downstroke. If the slope is more negative than the previously determined value the old value of Y' is replaced with the new Y', and the value of X where this more negative slope occurs, X(Y'min) is saved and averaged with the previous values to obtain a value of Xav. During the monitor mode Xav is averaged over a specified number of fluid pound sensitivity cycles rather than over calibration cycles as before. If the average X value at the point of most negative slope, Xav is less than Xset the fluid pound detector 92 (FIGS. 23, 24) sends a fluid pound message to the pump manager 91 and the motor 30 (FIG. 1) is disabled.

The present invention uses the position of the most negative slope of the sucker-rod position/sucker-rod load curve to determine when fluid pound is present in a subterranean well. The negative slope of the curve is calculated on the downstroke of the sucker-rod and the rod position at the position where the slope of the load change is maximum is compared to a reference position of the sucker-rod established during a calibration period. If the actual rod position at the point of most negative slope is below the reference position the well pumping unit is stopped.

Figure 28:
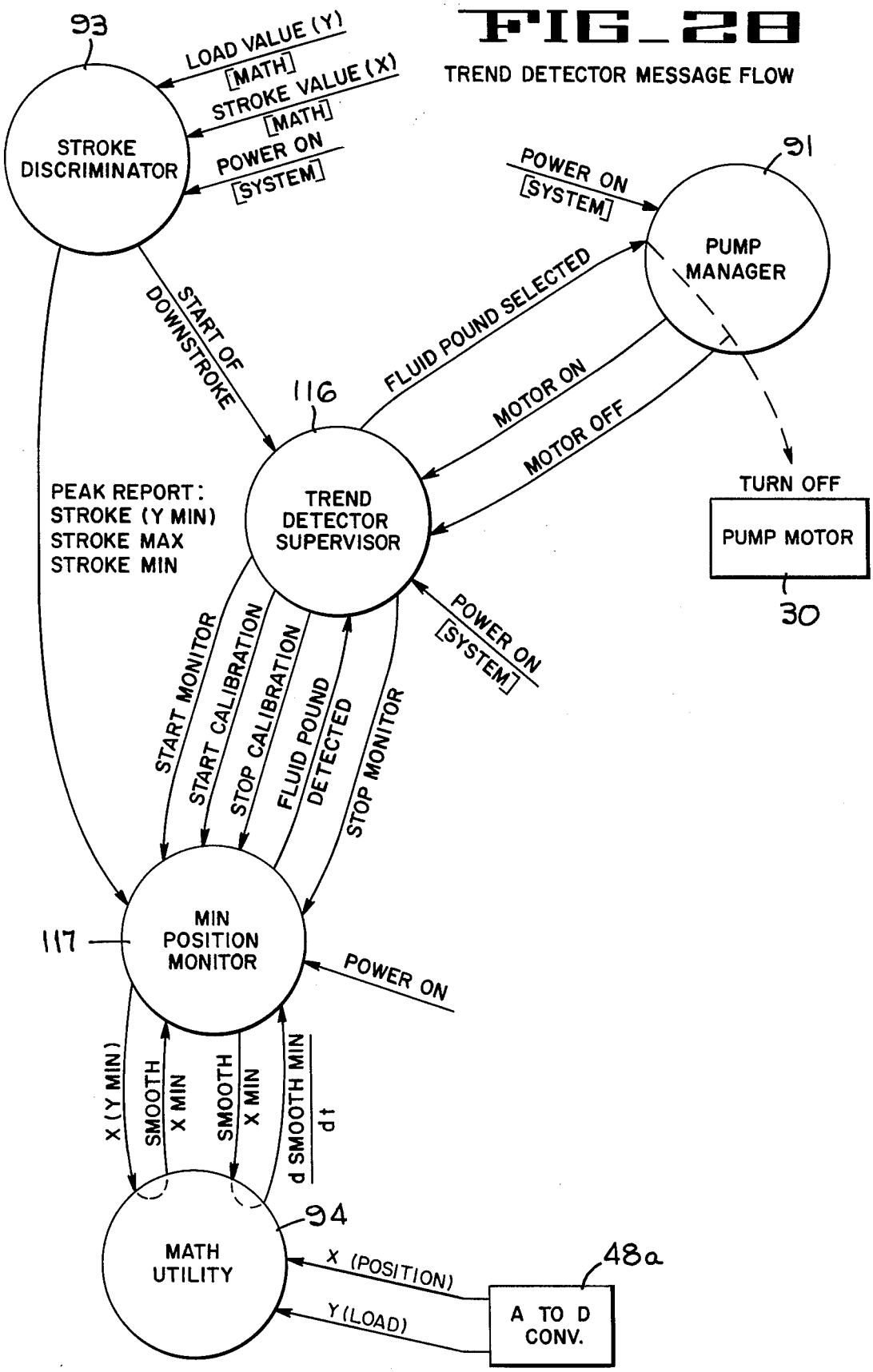
FIG. 28 is a message flow diagram for the third mode of operation of the apparatus of FIG. 1.
Figure 29:
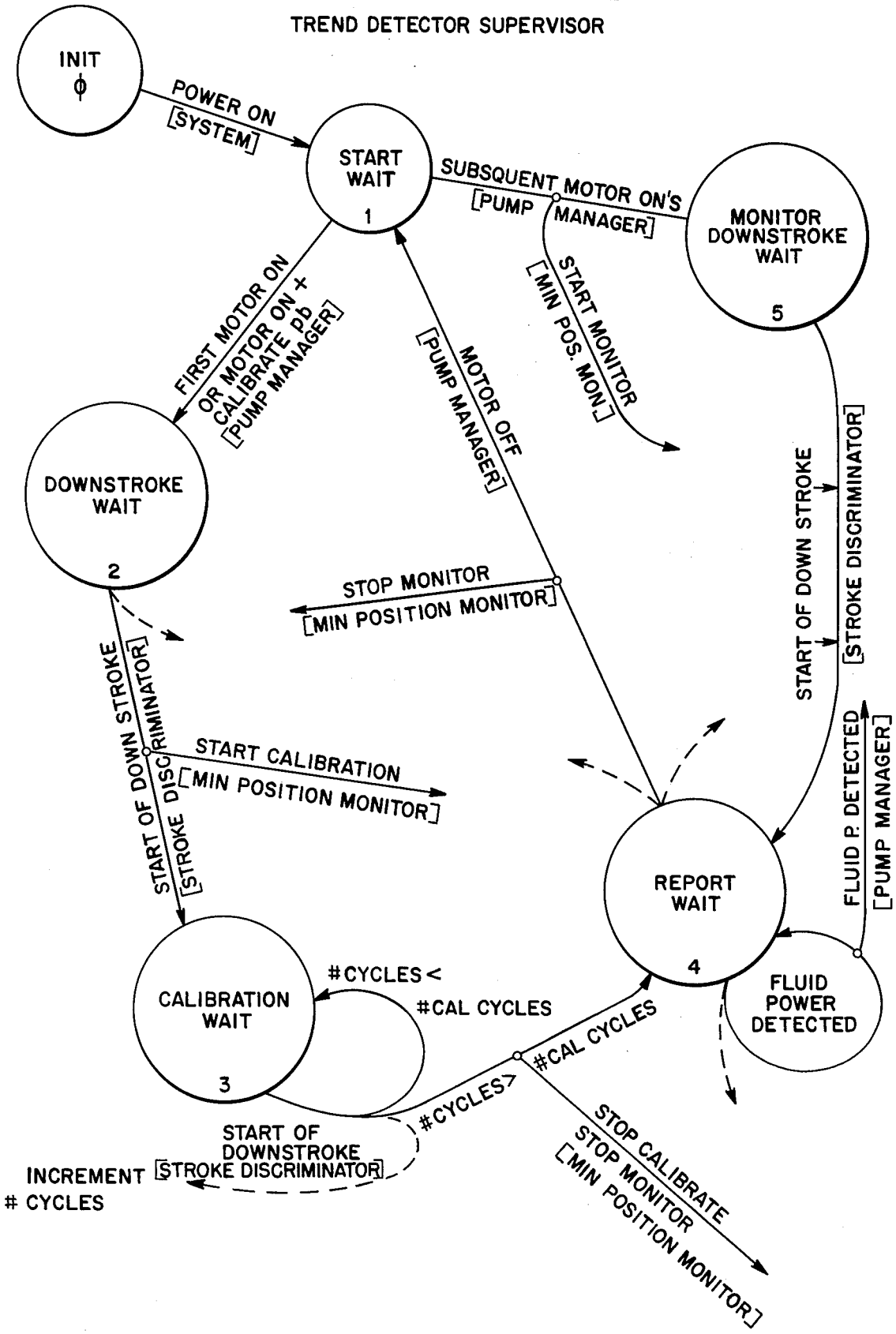
FIGS. 29 and 30 are software state diagrams illustrating the third mode of operation of the apparatus of FIG. 1.
Figure 30:
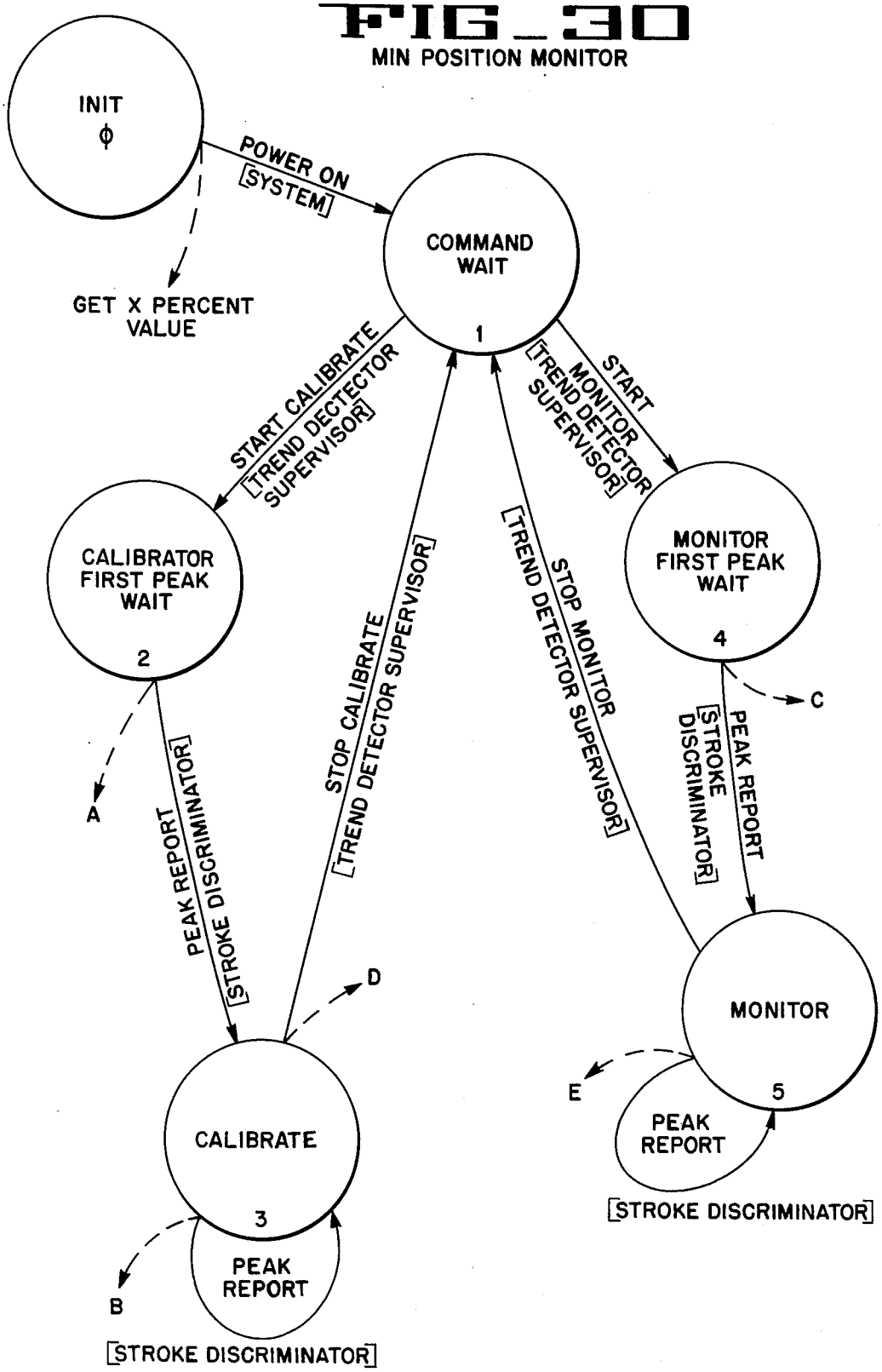

A third method of using the apparatus of FIGS. 1, 8A, 8B for detecting pump-off is disclosed in the message flow diagrams of FIGS. 28-30, in the load curve of FIG. 27 and in the calibration diagram of FIG. 26. The minimum value of load on the rod string Ymin is monitored and the direction of movement of Ymin is used to detect fluid pound. As the fluid level in a well decreases, the position of the minimum load, X(Ymin) progressively moves from point X(Y1min) (FIG. 27) to point X(Y2min) toward point X(Y5min). This progressive movement is detected by the apparatus of FIGS. 8A, 8B and when the movement has progressed over a predetermined amount a fluid pound signal is generated. A value of X, called Xset can be selected and when X(Ymin) reaches Xset the motor 30 (FIG. 1) is shut down.

The value Xset is calculated in computer 49*a* (FIG. 1) by first calculating a smoothed (average) value of X at which Ymin occurs, X(Ymin), when the well is filled with fluid. A human operator uses a keyboard 99 (FIG. 8B) or other input to the computer to enter a sensitivity value (percentage) which causes the computer 49*a* to calculate an Xset value a predetermined percent of the distance between Xmin and Xmax (FIG. 27). If the characteristics of the well or its pump, etc. should change so the curve of FIG. 23 changes the computer can recalculate the position of the set point Xset.

When the set point, Xset has been selected the computer continually monitors the value X(Ymin) of the curve (FIG. 23), a smoothed value is calculated and the direction of movement of the value of X(Ymin) is observed. If the value of X(Ymin) is less than the value of Xset and if the value of X(Ymin) is moving in a negative direction (toward the left in FIG. 23) the computer 49 (FIG. 1) provides a signal which causes the motor 30 to stop and the well is shut down.

The operation to detect pump-off using the trend of movement of the minimum point on the load curve is initiated by the power-on-reset generators 82*a*, 82*b* (FIGS. 8A, 8B) that provide signals which reset various hardware in the computer and cause the instruction of the computer program stored in the PROM 86*a* to be executed by the central processor 73*a*. A "power on" message is sent to each of the state machine modules 91, 93, 94, 116, and 117 (FIG. 28) in the computer and these state machine modules are initialized. The load signal values from the load cell 24 (FIG. 8A) and the stroke signal values from the transducer 53 are obtained from the math utility.

The power on message causes the trend detector supervisor 116 (FIGS. 28, 29) to be set in the "start wait" state, the min position monitor 117 (FIGS. 28, 29) to be set in the "command wait" state and causes an X % value to be sent to the min position monitor. The power on message causes the pump manager module 91 (FIG. 28) to provide power to the pump motor 30 (FIG. 8A) through a motor relay 98. The motor 30 moves the sucker-rod string 16 (FIG. 1) through a predetermined number of cycles to allow the fluid level in the well to stabilize, then the pump manager module 91 (FIG. 28) sends a "motor on" message to the trend detector supervisor 116 causing the supervisor (FIG. 28) to move into the downstroke wait state.

On the start of the next downstroke a "start calibration" message (FIGS. 28, 29) is sent to the min position monitor 117 and the cycle count is set to zero. When the min position monitor (FIG. 30) receives the start calibration message it waits for a peak report from the stroke discriminator 93 (FIG. 28). The peak report which occurs at the start of the downstroke includes values of Xmax, Xmin, and X(Ymin), (FIGS. 27, 28). When the first peak report is received (at A, FIG. 30) min' max is set to a value of zero and min' min is set to a value of −1. On subsequent reports during the calibration (at B) these values are sent to the math utility 94 (FIG. 28) which provides a moving average smoothed values of Xmin and provides a first derivative of the smooth value of Xmin. The value of the first derivative of the smooth value of Xmin is now referred to as min' and is compared to min' max and min' min. If the current value of min' min is greater than min' max then min' max is set to the current value of min'. If the current value of min' is less than min' min, then min' min is set to the current value of min'. Min' max and min' mim are actual boundaries of a noise band around the value of the derivative. A constant, K, is chosen and multiplied times the value of min' max and the value of min'min to establish a pair of zero band boundaries (FIG. 26) called min' high and min' low. No trend in the value of X(Ymin) is indicated within this band.

In the calibration at the start of each downstroke the trend detector supervisor (FIG. 29) increments the number of calibration cycles until the number of cycles is greater than the number of calibration cycles needed. When the number of calibration cycles exceeds the number of needed calibration cycles, a stop calibration message is sent from the trend detector supervisor 116 (FIG. 28) to the min position monitor 117. The min position monitor sets the min' zero band (FIG. 26), to a value where min' high is equal to K times the min' max value and the min' low is equal to K times the min' min value and Xset is $=X(Ymin)-X\ \%\ (Xmax-Xmin)$ and the min position monitor returns to the command wait state (FIG. 30) until it receives a start monitor message from the trend detector supervisor 116 (FIG. 28).

When the trend detector 116 (FIG. 28) sends a start monitor message to the min position monitor 117 the trend detector supervisor moves in one of two directions along the state diagram of FIG. 29. If this is the first time the pump motor has been turned on in the present sequence, the trend detector supervisor takes the route of steps 1, 2, 3, 4 (FIG. 29) through the downstroke wait state, to the calibration wait state on the downstroke of the rod string. The min position monitor (FIG. 30) moves into the monitor peak wait state. When the min position monitor receives a peak report containing X(Ymin), the monitor 117 (FIGS. 28, 30) calls the math utility 94 to provide a smooth moving averaged value of X(Ymin) and a first derivative of the smooth value X(Ymin). The min position monitor (FIG. 30) then moves to the monitor state.

In the monitor state, the min position monitor receives a new peak report at the start of each downstroke. This report includes the current values of the stroke position at minimum load, X(Ymin). If the current derivative is less than the zero band of FIG. 26 indicating a negative trend of X(Ymin), and if the current stroke position of the minimum load is less than Xset, then fluid pound is indicated using the following procedure: the min position monitor 117 (FIG. 28) receives the current values of Xmin, Xmax, and X(Ymin). The monitor 117 sends the values of X(Ymin) to the math utility 94 (FIG. 28) for smoothing and receives the smoothed value of X(Ymin). The monitor 117 then sends the smoothed value X(Ymin) to the math utility 94 and receives a smoothed value of X(Ymin)=min'. If min' is less than min' low (FIG. 26) and X(Ymin) (FIG. 27) is less than Xset then a "fluid pound detected" message is sent to the supervisor 116 (FIGS. 28, 29) and to the pump manager 92. The pump manager turns off the pump motor and the supervisor tells the min position monitor 117 to stop monitoring.

When the pump motor 30 (FIGS. 1, 8A) is again turned on the trend detector takes the route of steps 1, 5, 4 (FIG. 29) and eliminates the calibration portion of the state diagram of FIG. 29. If desired, calibration can also be performed at the start of each pumping episode by tracing the route 1, 2, 3, 4.

Although the best mode contemplated for carrying out the present invention has been herein shown and described, it will be apparent that modification and variation may be made without departing from what is regarded to be the subject matter of the invention.

What is claimed is:

1. Apparatus for monitoring the operation of a well pumping unit having a sucker-rod string and a power unit to reciprocate said rod string to produce fluid from an underground location, said apparatus comprising:

first transducer means for generating a signal representative of a load on said rod string;

second transducer means for generating a signal representative of a position of said rod string;

means for using a maximum value and a minimum value of said load signal to establish a selected value corresponding to said load signal, and for using a maximum and a mininum value of said rod signal to establish a reference position of said rod string;

means for periodically updating said selected value by combining an updated maximum load signal with a previous maximum load signal and combining an updated minimum load signal with a previous minimum load signal to obtain an updated selected value;

means for periodically updating said reference position by combining an updated maximum rod position signal with a previous maximum rod position signal and combining an updated minimum rod position signal with a previous minimum rod position signal to obtain an updated reference position; and means for disabling said power unit when said value corresponding to said load signal exceeds said updated selected value with said rod string at said updated reference position.

2. Apparatus for monitoring as defined in claim 1 wherein said reference position is on a downward stroke of said rod string.

3. Apparatus for monitoring the operation of a well pumping unit having a sucker-rod string and a power unit to reciprocate said rod string to produce fluid from an underground location, said apparatus comprising:

first transducer means for generating a signal representative of a load on said rod string;

second transducer means for generating a signal representative of a position of said rod string;

means for using a maximum value and a minimum value of said load signal to establish a selected value corresponding to said load signal, and for using a maximum value and a minimum value of said rod signal to establish a reference position of said rod string;

means for periodically updating said selected value by combining an updated maximum load signal with a previous maximum load signal and combining an updated minimum load signal with a previous minimum load signal to obtain an updated selected value;

means for periodically updating said reference position by combining an updated maximum rod position signal with a previous maximum rod position signal and combining an updated minimum rod position signal with a previous minimum rod position signal to obtain an updated reference position;

means for monitoring said load signal when said rod string reaches said updated reference position; and means for disabling said power unit when said value corresponding to said load signal exceeds said updated selected value with said rod string at said updated reference position.

4. Apparatus for monitoring as defined in claim 3 wherein said reference position is on a downward stroke of said rod string.

5. Apparatus for monitoring as defined in claim 3 wherein said power unit is disabled after said load signal exceeds said updated selected value a predetermined number of consecutive times at said updated reference position.

6. Apparatus for monitoring as defined in claim 3 including input means for entering a percent value of said rod signal and means for using said percent value in establishing said reference position of said rod string, said reference position changing due to a gradual change in the value of said rod signal.

7. Apparatus for monitoring as defined in claim 3 including means for entering a percent value of said load signal and means for using said percent value in establishing said selected value of said load, said selected value changing due to a gradual change in the value of said load signal.

8. Apparatus for monitoring as defined in claim 3 including input means for entering a percent value of X and a percent value of Y into said updating means, where the percent value of X is a predetermined percentage of the difference between a minimum value and a maximum value of said rod string position, and where the percent value of Y is a predetermined percentage of the difference between a minimum value and a maximum value of said load signal, and means for using said X percent and said Y percent values to establish said reference position of said rod string and of said selected value of said load signal.

9. Apparatus for monitoring as defined in claim 3 wherein said updating means uses at least one maximum value of said load signal and at least one minimum value of said load signal to establish said selected value of said load signal.

10. Apparatus for monitoring as defined in claim 9 wherein said power unit is disabled after said load signal exceeds said selected value a predetermined number of times at said reference position within a predetermined duration of time.

11. Apparatus for monitoring the operation of a well pumping unit having a sucker-rod string and a power unit to reciprocate said rod string to produce fluid from an underground location, said apparatus comprising:

first transducer means for generating a signal representative of a load on said rod string;

second transducer means for generating a signal representative of a position of said rod string;

a graph plotter for using said load signal and said position signal to produce a graph of rod string load vs. rod string position;

means for entering a selected value corresponding to said load signal and a reference position of said rod string as a set point on said graph;

means for periodically updating said selected value of said load signal by combining an updated maximum load signal with a previous maximum load signal and combining an updated minimum load signal with a previous minimum load signal to obtain an updated selected value;

means for periodically updating said reference position by combining an updated maximum rod position signal with a previous maximum rod position signal and combining an updated minimum rod position signal with a previous minimum rod position signal to obtain an updated reference position;

means for monitoring said load signal when said rod string reaches said updated reference position; and means for disabling said power unit when said load signal exceeds said updated selected value with said rod string at said updated reference position.

12. Apparatus for monitoring as defined in claim 11 including means for a human operator to enter said set point on said graph in response to a visual observation of said graph.

13. A method of monitoring the operation of an underground well pumping unit, said unit having a sucker-rod string, means to reciprocate said string to pump fluid, means for generating a signal representative of a load on said rod string, and means for generating a signal representative of a position of said rod string, said method comprising the steps of:

using said load signal to establish a selected value corresponding to said load signal;

using said rod string position signal to establish a reference position of said rod string;

updating said selected value periodically by combining an updated maximum load signal with a previous maximum load signal and combining an updated minimum load signal with a previous minimum load signal;

updating said reference position periodically by combining an updated maximum rod position signal with a previous maximum rod position signal and combining an updated minimum rod position signal with a previous minimum rod position signal; and stopping said pumping unit when said value corresponding to said signal exceeds said updated selected value with said rod string at said upated reference position.

14. A method of monitoring the operation of an underground well pumping unit, said unit having a sucker-rod string, means to reciprocate said string to pump fluid, means for generating a signal representative of a load on said rod string, and means for generating a signal representative of a position of said rod string, said method comprising the steps of:

using said load signal to establish a selected value corresponding to said load signal;

using said rod string position signal to establish a reference position of said rod string;

updating said selected value periodically by combining an updated maximum load signal with a previous maximum load signal and combining an updated minimum load signal with a previous minimum load signal;

updating said reference position periodically by combining an updated maximum rod position signal with a previous maximum rod position signal and combining an updated minimum rod position signal with a previous minimum rod position signal;

monitoring said load signal when said rod string reaches said updated reference position; and stopping said pumping unit when said value corresponding to said signal exceeds said updated selected value with said rod string at said updated reference position.

15. A method of monitoring the operation of an underground well pumping unit, said unit having a sucker-rod string, and means to reciprocate said rod string to pump fluid, said method comprising the steps of:

generating a signal representative of a load on said rod string;

generating a signal representative of a position of said rod string;

using said load signal to establish a selected value corresponding to said load signal.

using said string position signal to establish a reference position of said rod string;

updating said selected value periodically by combining an updated maximum load signal with a previous maximum load signal and combining an updated minimum load signal with a previous minimum load signal;

updating said reference position periodically by combining an updated maximum rod position signal with a previous maximum rod position signal and combining an updated minimum rod position signal with a previous minimum rod position signal;

monitoring said load signal when said rod string reaches said updated reference position; and stopping said pumping unit when said valve corresponding to said load signal exceeds said updated selected value with said rod string at said updated reference position.

16. A method as defined in claim 15 wherein said step of stopping said pumping unit includes the steps of checking the number of times said load signal exceeds said updated selected value and disabling said pumping unit after said load signal exceeds said updated selected value a predetermined number of times.

17. A method as defined in claim 15 wherein said step of using said string position signal to establish a reference position includes the steps of checking the direction of movement of said rod string and selecting said reference position on a downward stroke of said rod string.

18. A method as defined in claim 15 wherein said step of using said load signal to establish a selected value includes the step of using a pair of values of said load signal to determine said selected value, and said step of using said string position signal to establish a reference position includes the step of using a pair of values of said string position signals to determine said reference position.

19. A method as defined in claim 15 wherein said steps of using said load signal to establish a selected value and using said string position signal to establish a reference position includes the step of having a human operator select said reference position and select said selected value in response to an observation of said load signal and of said string positions.

20. A method of monitoring the operation of an underground well pumping unit, said unit having a sucker-rod string and means to reciprocate said rod string to pump fluid, said method comprising the steps of:

generating a signal representative of a load on said rod string;

generating a signal representative of a position of said rod string;

using a maximum value and a minimum value of said load signal to establish a selected value of said load signal;

using a maximum value and a minimum value of said string position to establish a reference position of said rod string;

updating said selected value periodically by combining an updated maximum load signal with a previous maximum load signal and combining an updated minimum load signal with a previous minimum load signal;

updating said reference position periodically by combining an updated maximum rod position signal with a previous maximum rod position signal and combining an updated minimum rod position signal with a previous mininum rod position signal;

monitoring said load signal when said rod string reaches said upated reference position; and stopping said pumping unit when said load signal exceeds said upated selected value with said rod string at said updated reference position.

21. A method as defined in claim 20 wherein said step of stopping said pumping unit includes the steps of checking the number of times said load signal exceeds said updated selected value and disabling said pumping unit after said load signal exceeds said updated selected value a predetermined number of times.

22. A method as defined in claim 20 wherein said step of using a maximum value and a minimum value of said string position to establish a reference position includes the steps of checking the direction of movement of said rod string and selecting said reference position on a downward stroke of said rod string.

23. A method as defined in claim 20 wherein said step of using a maximum value and a minimum value to establish a selected value includes the step of selecting a value a predetermined percent between said minimum and said maximum values, and wherein said step of using a maximum value and a minimum value to establish a reference position includes the step of selecting a position a predetermined percent of the distance between said minimum and said maximum positions.

24. A method as defined in claim 20 wherein said steps of using a maximum value and a minimum value to establish a selected value of said load signal and using a maximum value and a minimum value to establish a reference position includes the step of having a human operator select said reference position and select said selected value in response to an observation of said load signal and of said string positions.

25. A method as defined in claim 20 wherein said step of using a maximum value and a minimum value to establish a selected value of said load signal includes the step of having a human operator select a signal value as a percent of the difference between said minimum value and said maximum value of said load signal and said step of using a maximum value and a minimum value of said string position includes the step of having said human operator select said reference position as a percent of the difference between said minimum value and said maximum value of said string position.

26. A method of monitoring the operation of an underground well pumping unit, said unit having a sucker-rod string and means to reciprocate said rod string to pump fluid from a well, said method comprising the steps of:

generating a signal representative of a load on said rod string;

generating a signal representative of a position of said rod string;

using said load signal to establish the rate of change in said load on said rod string as said rod string moves in a downward direction;

selecting an average position of said rod string when said rate of change in said load has a maximum value with fluid filling said pumping unit;

using said average rod string position and a minimum rod string position to determine a reference position of said rod string; and stopping said pumping unit when said rod string position is below said reference position at the time said rate of change of load has a maximum value.

27. A method of monitoring the operation of an underground well pumping unit, said unit having a sucker-rod string and means to reciprocate said rod string to pump fluid from a well, said method comprising the steps of:

generating a signal representative of a load on said rod string;

generating a signal representative of a position of said rod string;

using said string position to establish a reference position of said rod string;

using said load signals and said position signals to determine the position of said rod string when said load signal has a minimum value;

monitoring the trend of movement of said rod position at said minimum load signal; and stopping said pumping unit when said rod position progressively moves downward at successive minimum load positions, to a position below said reference position.

28. A method of monitoring as defined in claim 27 wherein said step of using said string position to establish a reference position includes the step of selecting a position a predetermined percent of the distance between a minimum rod string position and a position of said rod string when said load signal has a minimum value with said well filled with fluid.

29. A method of monitoring as defined in claim 28 wherein said step of selecting a position includes having a human operator select said predetermined percent of said distance.

30. A method of monitoring the operation of an underground well pumping unit, said unit having a sucker-rod string and means to reciprocate said rod string to pump fluid from a well, said method comprising the steps of:

generating a signal representative of a load on said rod string;

generating a signal representative of a position of said rod string;

using said load signal and said position signal to determine the rod string position each time said load signal has a minimum value during the downstroke of said rod string;

establishing a calibrate position of said rod string at a minimum load signal with fluid filling the pumping unit;

using said calibrate position and a minimum rod string position to determine a reference position of said rod string; and stopping said pumping unit when said rod position progressively moves downward at successive minimum load positions, to a position below said reference position.

31. A method of monitoring as defined in claim 30 wherein said step of using said calibrate position and a minimum rod string position includes the step of selecting a position a predetermined percent of the distance between said minimum rod string position and said calibrate position to determine said reference position.

* * * * *